US011069459B2

(12) United States Patent
Kobayashi et al.

(10) Patent No.: US 11,069,459 B2
(45) Date of Patent: Jul. 20, 2021

(54) COVERED ELECTRICAL WIRE AND TERMINAL-EQUIPPED ELECTRICAL WIRE

(71) Applicants: AUTONETWORKS TECHNOLOGIES, LTD., Yokkaichi (JP); SUMITOMO WIRING SYSTEMS, LTD., Yokkaichi (JP); SUMITOMO ELECTRIC INDUSTRIES, LTD., Osaka (JP)

(72) Inventors: Hiroyuki Kobayashi, Yokkaichi (JP); Kei Sakamoto, Osaka (JP)

(73) Assignees: AUTONETWORKS TECHNOLOGIES, LTD., Yokkaichi (JP); SUMITOMO WIRING SYSTEMS, LTD., Yokkaichi (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 0 days.

(21) Appl. No.: 16/628,458

(22) PCT Filed: Jul. 4, 2018

(86) PCT No.: PCT/JP2018/025419
§ 371 (c)(1),
(2) Date: Jan. 3, 2020

(87) PCT Pub. No.: WO2019/013073
PCT Pub. Date: Jan. 17, 2019

(65) Prior Publication Data

US 2021/0134483 A1 May 6, 2021

(30) Foreign Application Priority Data

Jul. 14, 2017 (JP) ..... JP2017-138645

(51) Int. Cl.
*H01B 7/02* (2006.01)
*H01B 1/02* (2006.01)
(Continued)

(52) U.S. Cl.
CPC ..... *H01B 7/0275* (2013.01); *H01B 1/026* (2013.01); *H01B 7/0009* (2013.01); *H01B 7/0216* (2013.01); *H01R 4/185* (2013.01)

(58) Field of Classification Search
CPC ..... H01B 7/0009; H01B 5/08; H01B 7/0045; H01B 1/026; H01B 7/0275; H01B 7/0216;
(Continued)

(56) References Cited

U.S. PATENT DOCUMENTS 2,842,837 A * 7/1958 Huet ..... C10M 7/00 72/42
3,445,394 A * 5/1969 Hunt ..... H01B 3/441 524/87
(Continued)

FOREIGN PATENT DOCUMENTS

CN 106029930 A 10/2016
JP 2004-107700 A 4/2004
(Continued)

OTHER PUBLICATIONS

Oct. 2, 2018 Search Report issued in International Patent Application No. PCT/JP2018/025419.

*Primary Examiner* — Timothy J Thompson
*Assistant Examiner* — Michael F McAllister
(74) *Attorney, Agent, or Firm* — Oliff PLC

(57) ABSTRACT

A covered electrical wire including a conductor and an insulating coating layer covering an outer periphery of the conductor, in which the conductor is a twisted wire obtained by concentrically twisting together a plurality of elemental
(Continued)

wires constituted by a copper alloy, the copper alloy contains one or more elements selected from Fe, Ti, Mg, Sn, Ag, Ni, In, Zn, Cr, Al, and P in a total amount of 0.01 mass % to 5.5 mass % inclusive, and the remaining portion includes Cu and inevitable impurities, and an amount of oil adhering to a surface of a central elemental wire disposed at a central portion of the twisted wire is 10 μg/g or less with respect to the mass of the central elemental wire.

18 Claims, 3 Drawing Sheets

(51) Int. Cl.
*H01B 7/00* (2006.01)
*H01R 4/18* (2006.01)

(58) Field of Classification Search
CPC .... C22C 9/01; C22C 9/04; C22C 9/06; C22C 9/02
USPC ..... 174/75 R
See application file for complete search history.

(56) References Cited

U.S. PATENT DOCUMENTS 4,559,200 A * 12/1985 Yamasaki ..... C22C 9/00 420/492
5,149,917 A * 9/1992 Sawada ..... B60R 16/0215 174/110 OR
5,213,644 A * 5/1993 Phillips ..... H01B 13/0285 118/420
9,875,827 B2 * 1/2018 Yoshinaga ..... C22F 1/08
2002/0044881 A1 * 4/2002 Breedis ..... C22C 9/00 420/496
2004/0166017 A1 * 8/2004 Caron ..... C22C 9/06 420/492
2004/0238086 A1 * 12/2004 Saleh ..... C22C 9/00 148/684
2006/0131173 A1 6/2006 Kawanami et al.
2010/0018745 A1 * 1/2010 Tsukamoto ..... C22C 9/06 174/113 R
2011/0005805 A1 1/2011 Eshima
2013/0092437 A1 * 4/2013 Yoshinaga ..... C22C 9/06 174/75 R
2015/0371726 A1 * 12/2015 Inoue ..... H01B 3/44 174/74 R
2016/0012943 A1 * 1/2016 Rachi ..... H01R 4/185 174/72 A
2016/0254074 A1 * 9/2016 Kobayashi ..... C22C 9/00 174/74 R
2016/0284437 A1 * 9/2016 Inoue ..... H01B 7/0036
2016/0368035 A1 * 12/2016 Kobayashi ..... H01B 1/026
2017/0040081 A1 * 2/2017 Kobayashi ..... C22C 9/04
2017/0229211 A1 * 8/2017 Yoshida ..... H01B 7/0045

FOREIGN PATENT DOCUMENTS

JP 2012-146431 A 8/2012
JP 2014-032819 A 2/2014
JP 2015-086452 A 5/2015

* cited by examiner

COVERED ELECTRICAL WIRE AND TERMINAL-EQUIPPED ELECTRICAL WIRE

TECHNICAL FIELD

The present disclosure relates to a covered electrical wire and a terminal-equipped electrical wire.

The present application claims the benefit of priority based on Japanese Patent Application No. 2017-138645 filed on Jul. 14, 2017, which is incorporated herein by reference in its entirety.

BACKGROUND ART

Patent Documents 1 and 2 disclose wire harnesses used in automobiles. A wire harness is typically a bundle of terminal-equipped electrical wires that include covered electrical wires provided with insulating coating layers on the periphery of conductors thereof, and terminal portions attached to end portions of the covered electrical wires. Patent Document 1 discloses, as a conductor having good weld strength (peeling force) when a branch line is welded thereto, a copper alloy twisted wire with good impact resistance even if the cross-sectional area of the conductor is as small as 0.22 $mm^2$ or less, the copper alloy twisted wire being obtained by twisting together seven copper alloy wires of a specific composition. Patent Document 2 discloses a copper alloy twisted wire obtained by twisting together three Cu—Sn alloy wires, as a conductor having good weld strength.

CITATION LIST

Patent Documents

Patent Document 1: JP 2015-086452A
Patent Document 2: JP 2012-146431A

SUMMARY OF INVENTION

A covered electrical wire according to the present disclosure is a covered electrical wire including a conductor and an insulating coating layer covering an outer periphery of the conductor, in which the conductor is a twisted wire obtained by concentrically twisting together a plurality of elemental wires constituted by a copper alloy, the copper alloy contains one or more elements selected from Fe, Ti, Mg, Sn, Ag, Ni, In, Zn, Cr, Al, and P in a total amount of 0.01 mass % to 5.5 mass % inclusive, and the remaining portion includes Cu and inevitable impurities, and an amount of oil adhering to a surface of a central elemental wire disposed at a central portion of the twisted wire is 10 μg/g or less with respect to the mass of the central elemental wire.

A terminal-equipped electrical wire according to the present disclosure includes:

the covered electrical wire according to the present disclosure; and a terminal portion attached to an end portion of the covered electrical wire.

DESCRIPTION OF EMBODIMENTS

Figure 1:
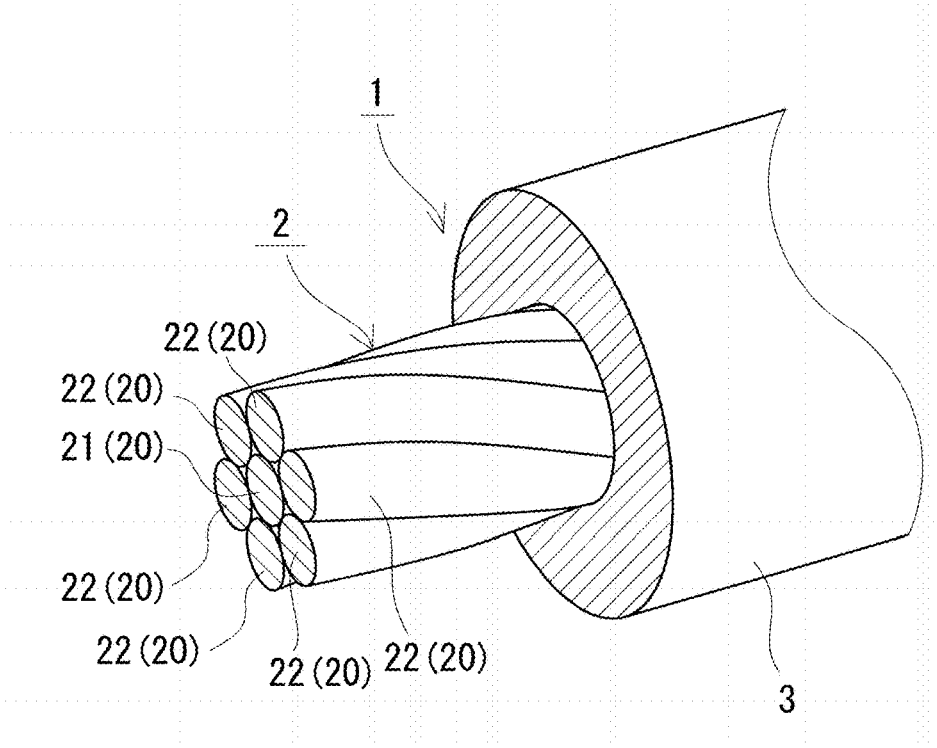
FIG. 1 is a schematic perspective view showing an example of a covered electrical wire according to an embodiment.

Problem to be Solved by the Present Disclosure

There is demand for a covered electrical wire that is unlikely to buckle, the covered electrical wire being used with a terminal portion attached to an end portion thereof, as the above-described terminal-equipped electrical wire provided in a wire harness.

If the cross-sectional area of a conductor is reduced (if the diameter thereof is reduced) as disclosed in Patent Documents 1 and 2, even if the conductor is constituted by a copper alloy, the conductor can be reduced in weight. However, if the cross-sectional area of a conductor is reduced, the rigidity of the conductor is likely to decrease, and the rigidity of a covered electrical wire is also likely to decrease. If a covered electrical wire having low rigidity is used in the above-described terminal-equipped electrical wire, there is a possibility that a portion located near a terminal portion of the covered electrical wire will locally buckle (so-called bend) when the terminal portion is inserted into a terminal housing portion of a housing, for example. Thus, from the viewpoint of improving the workability for inserting a terminal portion, there is demand for a covered electrical wire that is unlikely to buckle even if the cross-sectional area of a conductor is small.

Also, there is demand for a further reduction in contact resistance to a terminal portion of a covered electrical wire that is used with a terminal portion attached to an end portion thereof as described above.

Patent Document 1 discloses that contact resistance is low when a terminal portion is fixed through crimping to a twisted wire conductor in which the conductor has a cross-sectional area of 0.22 $mm^2$ or 0.13 $mm^2$, when the crimping height is set to 0.76. Here, it is conceivable that, when a crimp terminal is attached, if the degree of compression therefor is increased, a large area of contact between each elemental wire and the terminal portion can be easily secured by cancelling a twisted state of a twisted wire, and contact resistance is likely to decrease. However, the larger the above-described degree of compression is, the smaller the remaining area ratio of a compressed portion of the conductor where the terminal portion is compressed is. Thus, in the compressed portion of the conductor where the terminal portion is compressed and the vicinity thereof, a tolerable force (N) at which breakage does not occur when an impact is applied is smaller, compared to an uncompressed portion of the conductor to which no terminal portion is attached, and thus the compressed portion and the vicinity thereof prove to be a weakpoint in terms of impact resistance, for example. If the above-described degree of compression is reduced, a large remaining area ratio of the compressed portion of the conductor where the terminal portion is compressed and the vicinity thereof can be secured, good properties of an uncompressed portion thereof, for example, impact resistance, can be maintained, and thus a terminal-equipped electrical wire having good impact resistance can be obtained. Thus, there is demand for a covered electrical wire having low contact resistance even if a conductor has a small cross-sectional area as described above, in particular, even if a conductor has a cross-sectional area of 0.22 $mm^2$ or less, and even if the above-described degree of compression is smaller, in particular, even if the remaining area ratio of the conductor where the terminal portion is compressed exceeds 0.76.

Also, there is demand for a further increase in weld strength (peeling force) when a branch line or the like is welded to a covered electrical wire that is used with a terminal portion attached to an end portion thereof as described above.

In particular, if twisted wire conductors have the same cross-sectional area, a twisted wire conductor in which seven elemental wires are concentrically twisted together as described in Patent Document 1 can be more easily bent and used in a wire harness or the like, compared to a twisted wire conductor in which three elemental wires are twisted as described in Patent Document 2. Thus, there is demand for an increase in weld strength of a covered electrical wire provided with a concentrically twisted wire conductor.

In view of this, an object of the present disclosure is to provide a covered electrical wire and a terminal-equipped electrical wire that are unlikely to buckle.

Advantageous Effects of the Present Disclosure

A covered electrical wire according to the present disclosure and a terminal-equipped electrical wire according to the present disclosure are unlikely to buckle.

DESCRIPTION OF EMBODIMENTS OF THE PRESENT DISCLOSURE

First, embodiments of the present disclosure will be described below.

(1) A covered electrical wire according to an aspect of the present disclosure is a covered electrical wire including a conductor and an insulating coating layer covering an outer periphery of the conductor, in which the conductor is a twisted wire obtained by concentrically twisting together a plurality of elemental wires constituted by a copper alloy, the copper alloy contains one or more elements selected from Fe, Ti, Mg, Sn, Ag, Ni, In, Zn, Cr, Al, and P in a total amount of 0.01 mass % to 5.5 mass % inclusive, and the remaining portion includes Cu and inevitable impurities, and an amount of oil adhering to a surface of a central elemental wire disposed at a central portion of the twisted wire is 10 μg/g or less with respect to the mass of the central elemental wire.

Exemplary examples of the above-described oil include mineral oil and synthetic oil, and the oil originates from a lubricant (also having a function other than a lubrication function, such as a discoloration prevention function) that is used in a manufacturing process. Exemplary examples of the above-described oil include lubricants that are used in plastic forming such as wiredrawing.

The above-described concentric twisting refers to concentrically twisting together a plurality of outer peripheral elemental wires around at least one elemental wire serving as a central elemental wire to cover an outer periphery of the central elemental wire.

The above-described twisted wire includes a compressed twisted wire obtained through compression molding after performing twisting, in addition to an uncompressed twisted wire that is obtained by twisting together a plurality of elemental wires (copper alloy wires here) and is not subjected to compression molding.

Although the above-described covered electrical wire is a twisted wire in which the conductor is concentrically twisted, the covered electrical wire is unlikely to buckle because of the following reasons. With the above-described covered electrical wire, the content of oil adhering to the surface of the central elemental wire constituting a twisted wire is low. Here, if a conductor is a twisted wire, typically, wires that are manufactured under the same manufacturing conditions are used as elemental wires that are used in a twisted wire. Thus, if the amount of oil adhering to the surface of the central elemental wire is small, it can be said that the amount of oil adhering to the surface of each outer peripheral elemental wire is also small, and the amount of oil adhering to the surfaces of all elemental wires constituting the above-described twisted wires is also small. Thus, the content of oil present between elemental wires and the content of oil present between the insulating coating layer and the outer peripheral elemental wire constituting the outermost portion of the conductor are low, and thus the friction between elemental wires and the friction between the insulating coating layer and the above-described outer peripheral elemental wire are likely to increase. It can be said that the above-described covered electrical wire in which such a twisted wire is used as a conductor has good rigidity, from the viewpoint that the elemental wires, the conductor, and the insulating coating layer are likely to move as a whole due to the elemental wires, and the conductor and the insulating coating layer being unlikely to slide against each other. Even if the conductor has a small cross-sectional area, in particular, even if the conductor has a cross-sectional area of 0.22 $mm^2$ or less, 0.2 $mm^2$ or less, or 0.15 $mm^2$ or less, as described above, the covered electrical wire has good rigidity because the friction between elemental wires and the friction between the conductor and the insulating coating layer are large. The above-described covered electrical wire is unlikely to buckle because the covered electrical wire has good rigidity overall. If such a covered electrical wire described above is used as a terminal-equipped electrical wire, a portion located near a terminal portion is unlikely to buckle when the terminal portion is inserted into a terminal housing portion of a housing, for example, and such a covered electrical wire has good insertion workability.

Also, the above-described covered electrical wire has low contact resistance to a terminal portion when the terminal portion is attached to an end portion of the covered electrical wire. Although oil content adhering to the surfaces of the elemental wires constituting the above-described conductor is usually an electrical insulating material, with the above-described covered electrical wire, as described above, only low oil content adheres thereto, and thus the oil content present between the conductor and the terminal portion is low. Here, it is conceivable that, even if the above-described oil adhering amount is somewhat high, if a terminal portion is attached at a large degree of compression, elemental wires locally rub against each other at a compressed portion of the conductor where the terminal portion is compressed, thus removing the oil content, and reducing contact resistance. In contrast, with the above-described covered electrical wire, the above-described oil adhering amount is small, and thus, even if the above-described degree of compression is reduced, contact resistance can be reduced. If the above-described degree of compression is small, the remaining area ratio of a compressed portion of the conductor where the terminal portion is compressed can be increased, and good characteristics of an uncompressed portion of the conductor can be maintained. Even if a conductor has a small cross-sectional area, in particular, even if a conductor has a cross-sectional area of 0.22 $mm^2$ or less, 0.2 $mm^2$ or less, or 0.15 $mm^2$ or less, for example, if the conductor has good impact resistance, it is possible to construct a terminal-equipped electrical wire having good impact resistance. When such a covered electrical wire described above is used as a terminal-equipped electrical wire, even if the conductor has a small cross-sectional area as described above, and even if the above-described degree of compression is reduced, the covered electrical wire has low contact resistance and good impact resistance.

Also, the above-described covered electrical wire has good weld strength when a branch line or the like is welded to a conductor constituted by a centrically twisted wire. This is because a conversion product originating from oil content and the like is unlikely to be produced in welding due to oil content adhering to the surfaces of the elemental wires constituting the conductor being low as described above, and a decrease in strength resulting from a conversion product being present at a welding portion is unlikely to occur.

(2) As one mode of the above-described covered electrical wire, the covered electrical wire includes a coating film made of copper oxide on surfaces of the elemental wires, and the coating film has a thickness of 10 nm or less.

In the above-described mode, although the covered electrical wire has a coating film that includes an electrical insulating material and is made of copper oxide, the coating film is sufficiently thin. Thus, the above-described mode makes it possible to further reduce contact resistance to the terminal portion. Also, in the above-described mode, a decrease in weld strength resulting from the presence of copper oxide is suppressed, and better weld strength is obtained.

(3) As one mode of the above-described covered electrical wire, the conductor has a tensile strength of 450 MPa or more, and has a breaking elongation of 5% or more.

In the above-described mode, tensile strength is high, and thus the covered electrical wire is less likely to buckle. Also, in the above-described mode, the covered electrical wire has higher weld strength. Also, in the above-described mode, the conductor has high tensile strength and high breaking elongation, and thus has better impact resistance.

(4) As one mode of the above-described covered electrical wire, the conductor has a cross-sectional area of 0.22 $mm^2$ or less, and the twisted wire has a twist pitch of 12 mm or more.

In the above-described mode, although the conductor has a small cross-sectional area, the twisted wire has a long twist pitch, and thus the conductor has higher strength and is less likely to buckle.

(5) As one mode of the above-described covered electrical wire, when the minimum distance between an outer circumferential surface of the insulating coating layer and a crown portion, excluding a twisting groove, of an outer circumferential surface of each outer peripheral elemental wire disposed on the outermost side of the twisted wire is a thickness of the insulating coating layer, a ratio of the minimum value of the thickness to the maximum value of the thickness is 80% or more.

In the above-described mode, it can be said that the conductor is provided with the insulating coating layer at an even thickness, and rigidity is further increased due to the conductor and the insulating coating layer serving as a single member, and the conductor is less likely to buckle.

(6) A terminal-equipped electrical wire according to an aspect of the present disclosure includes the covered electrical wire according to any one of (1) to (5) above, and a terminal portion attached to an end portion of the covered electrical wire.

Because the above-described terminal-equipped electrical wire includes the above-described covered electrical wire in which the twisted wire with a small oil adhering amount, which has been described above, serves as a conductor, as described above, the terminal-equipped electrical wire exhibits the effects of being unlikely to buckle, having low contact resistance between the conductor and the terminal portion, and having good weld strength.

(7) As one mode of the above-described terminal-equipped electrical wire, when a ratio of a cross-sectional area of a compressed portion of the conductor to which the terminal portion is attached to a cross-sectional area of an uncompressed portion of the conductor to which the terminal portion is not attached is a remaining area ratio, the remaining area ratio exceeds 0.76.

In the above-described mode, although the conductor remaining area of the compressed portion of the conductor where the terminal portion is compressed is large, the oil adhering amount is small as described above, and thus, contact resistance is low. Also, in the above-described mode, the above-described conductor remaining area is large, and thus characteristics of the uncompressed portion of the conductor, such as impact resistance, can be maintained, and good impact resistance and the like are obtained.

DETAILS OF EMBODIMENTS OF THE PRESENT DISCLOSURE

Hereinafter, embodiments of the present disclosure will be described in detail with reference to the drawings as appropriate. In the figures, components with the same name are denoted by the same reference numeral. In the composition of a copper alloy, the content of an element is indicated using a mass fraction (mass % or mass ppm), unless otherwise specified.

Covered Electrical Wire

As shown in FIG. 1, a covered electrical wire 1 according to an embodiment includes a conductor 2 and an insulating coating layer 3 covering an outer periphery of the conductor 2. The conductor 2 is a twisted wire obtained by concentrically twisting together a plurality of elemental wires 20 constituted by a copper alloy. The copper alloy contains one or more elements selected from Fe, Ti, Mg, Sn, Ag, Ni, In, Zn, Cr, Al, and P in a total amount of 0.01% to 5.5% inclusive, and the remaining portion includes Cu and inevitable impurities. This twisted wire is obtained by concentrically twisting a plurality of outer peripheral elemental wires 22 around the outer periphery of one or more central elemental wires 21. FIG. 1 shows a case of a 7-twisted wire where six outer peripheral elemental wires 22 are twisted around the outer periphery of one central elemental wire 21. The covered electrical wire 1 of this embodiment has a feature in that low oil content adheres to the surface of the central elemental wire 21 disposed at the central portion of the twisted wire, out of the elemental wires 20 constituting the conductor 2. Quantitatively, the amount of oil adhering to the surface of the central elemental wire 21 is 10 μg/g or less with respect to mass (g) of the central elemental wire 21. Hereinafter, the conductor 2 and the insulating coating layer 3 will be described in this order.

Conductor

The elemental wires 20 that constitute the conductor 2 are each a wire constituted by a copper alloy that includes additive elements and the remaining portion includes Cu and inevitable impurities. The additive elements may be one or more elements selected from Fe, Ti, Mg, Sn, Ag, Ni, In, Zn, Cr, Al, and P. The total content of the additive elements may be 0.01% to 5.5% inclusive. The higher the total content of additive elements is, the higher the tensile strength tends to be and thus the higher the strength and the rigidity are, and the lower the total content of additive elements is, the higher the electrical conductivity tends to be, although this feature depends on the type of additive element. Specific examples of the composition are as follows (the remaining portion includes Cu and inevitable impurities).

Composition (1 precipitation+solid-solution alloy) contains Fe in an amount of 0.2% to 2.5% inclusive, Ti in an amount of 0.01% to 1.0% inclusive, and one or more elements selected from Mg, Sn, Ag, Ni, In, Zn, Cr, Al, and P in a total amount of 0.01% to 2.0% inclusive.

Composition (2 precipitation+solid-solution alloy) contains Fe in an amount of 0.1% to 1.6% inclusive, P in an amount of 0.05% to 0.7% inclusive, and at least one of Sn and Mg in a total amount of 0% to 0.7% inclusive.

Composition (3 solid-solution alloy) contains Sn in an amount of 0.15% to 0.7% inclusive.

Composition (4 solid-solution alloy) contains Mg in an amount of 0.01% to 1.0% inclusive.

In the composition (1), the Fe content may be 0.4% to 2.0% inclusive, and 0.5% to 1.5% inclusive, the Ti content may be 0.1% to 0.7% inclusive, and 0.1% to 0.5% inclusive, the Mg content may be 0.01% to 0.5% inclusive, and 0.01% to 0.2% inclusive, the Sn content may be 0.01% to 0.7% inclusive, and 0.01% to 0.3% inclusive, the Ag content may be 0.01% to 1.0% inclusive, and 0.01% to 0.2% inclusive, and the total content of Ni, In, Zn, Cr, Al, and P may be 0.01% to 0.3% inclusive, and 0.01% to 0.2% inclusive.

In the composition (2), the Fe content may be 0.2% to 1.5% inclusive, and 0.3% to 1.2% inclusive, the P content may be 0.1% to 0.6% inclusive, and 0.11% to 0.5% inclusive, the Mg content may be 0.01% to 0.5% inclusive, and 0.02% to 0.4% inclusive, and the Sn content may be 0.05% to 0.6% inclusive, and 0.1% to 0.5% inclusive.

In the composition (3), the Sn content may be 0.15% to 0.5% inclusive, and 0.15% to 0.4% inclusive.

In the composition (4), the Mg content may be 0.02% to 0.5% inclusive, and 0.03% to 0.4% inclusive.

In addition, the alloy may contain one or more elements selected from C, Si, and Mn in a total amount of 10 ppm to 500 ppm inclusive. These elements may function as an antioxidant for elements such as Fe and Sn described above.

Structure

In the case of a precipitation copper alloy (e.g., the above-described compositions (1) and (2)) in which the copper alloy constituting the elemental wires 20 forms precipitates when aging is performed, if aging is performed, the precipitation copper alloy typically has a structure including precipitates. When the copper alloy has a structure in which precipitates are evenly dispersed, higher strength resulting from precipitation strengthening, and higher electrical conductivity resulting from a decrease in the solid-solution amount of additive elements can be expected, for example.

It is found that, when the above-described copper alloy has a structure including precipitates, if the number of coarse precipitates is somewhat small, weld strength can be easily increased. It is preferable that, quantitatively, the number of precipitates having a particle size of 1 μm or more is less than 20,000 per 1 $mm^2$ (less than 20,000/$mm^2$) in an observation image obtained through microscopy of the longitudinal section of the conductor 2. This is because weld strength is likely to decrease because, if the conductor 2 includes a large number of coarse precipitates before being subjected to welding, it is difficult to melt the conductor 2, and welding cannot be performed appropriately, or these coarse particles may remain at a welding portion and cause a crack, for example. In particular, if a conductor of another covered electrical wire that is to be welded to the conductor 2 or the like is made of pure copper, weldability is likely to decrease due to a difference between structures thereof. Thus, considering an improvement in weld strength, a smaller number of coarse precipitates described above is more preferable, and is preferably 19,000/$mm^2$ or less, 15,000/$mm^2$ or less, 10,000/$mm^2$ or less, and 8,000/$mm^2$ or less. The size and the number of precipitates can be controlled by adjusting aging conditions according to the composition of the copper alloy, for example. A detailed method for measuring precipitates and aging conditions will be described later. Note that the longitudinal section of the conductor 2 refers to a cross-section obtained by cutting the conductor 2 along a plane parallel to the longitudinal direction of the conductor 2.

Surface State

Oil Adhering Amount

In the covered electrical wire 1 of this embodiment, the amount of oil adhering to the surface of an elemental wire 20 is small. Quantitatively, the mass of the oil content adhering to the surface of the central elemental wire 21 is 10 μg or less with respect to 1 g mass of the central elemental wire 21. When the central elemental wire 21 and the outer peripheral elemental wires 22 are made of a copper alloy having the same composition, these elemental wires 21 and 22 may be manufactured under the same manufacturing conditions. In this case, the oil adhering amount of the central elemental wire 21 and the oil adhering amount of the outer peripheral elemental wires 22 may substantially be equal to each other. However, when the insulating coating layer 3 is removed from the covered electrical wire 1 when an oil adhering amount is to be measured, the oil content of the surface of an outer peripheral elemental wire 22 may adhere to the insulating coating layer 3, and the oil adhering amount possibly cannot be appropriately measured. In view of this, the oil content of the surface of the central elemental wire 21 that is not in contact with the insulating coating layer 3 is measured.

Because the amount of oil adhering to the surface of the central elemental wire 21 is small as described above, it can be said that the amount of oil adhering to the surface of the outer peripheral elemental wire 22 is small in a similar manner, and the surfaces of all elemental wires 20 have low oil content. As a result, the friction between adjacent elemental wires 20, and the friction between the conductor 2 and the insulating coating layer 3 is likely to increase, and the constituent elements of the covered electrical wire 1 are likely to move as a whole and are unlikely to buckle. Also, as a result of a small oil adhering amount, when a terminal portion is attached to an end portion of the covered electrical wire 1, oil content between the conductor 2 and the terminal portion is likely to be small, and thus contact resistance between the conductor 2 and the terminal portion can be reduced. Also, as a result of a small oil adhering amount, when a branch line or the like is welded to the conductor 2, a conversion product resulting from oil content is unlikely to be present at a welding portion, and weld strength can be increased. The smaller the oil adhering amount is, the more likely the above-described friction is to increase, the less likely the covered electrical wire 1 is to buckle, the more likely the oil content between the conductor 2 and the terminal portion is to be reduced, the more likely the contact resistance between the conductor 2 and the terminal portion is to decrease, the more likely the presence of a conversion product at a welding portion is to be suppressed, and the higher the weld strength is likely to be. Thus, the above-described oil adhering amount is preferably 9.5 μg/g or less, 9 μg/g or less, and 8.8 μg/g or less. Note that, if the oil adhering amount is too small, there is a possibility that elemental wires 20 will be less likely to slide against each other, and it will be difficult to perform appropriate bending or the like. Thus, it is conceivable that the above-described oil adhering amount is preferably 0.5 μg/g or more, and 1 μg/g or more. A method for measuring an oil adhering amount will be described later.

The above-described oil content adhering to the surface of an elemental wire 20 typically originates from a lubricant (a lubricant for wiredrawing or the like) used in a manufacturing process. Thus, an example of the method for reducing the oil adhering amount is reducing the amount of a lubricant applied during wiredrawing, for example. In addition, an example thereof includes active reduction and removal of oil content by adjusting heat-treatment conditions in a case where heat treatment such as aging and softening is performed. Heat treatment for reducing and removing oil content can also be performed separately. Even if the amount of a lubricant applied during wiredrawing is increased, the above-described oil adhering amount can be reliably reduced and removed by performing heat treatment in a downstream process. The heat treatment conditions will be described later.

When the above-described oil adhering amount is measured, if the central elemental wire 21, which is a measurement object, has a length of 20 m or more, a large amount of the oil content to be measured can be secured, and measurement accuracy can be increased. In a state where a covered electrical wire is wound on a reel, for example, it is sufficient that the covered electrical wire is unwound, an electrical wire test piece having a length of 20 m or more is cut therefrom, a conductor is taken out from the electrical wire test piece, and the amount of oil adhering to the central elemental wire is measured. Alternatively, there are also cases where covered electrical wires provided in a wire harness for automobiles and robots each have a length of less than 20 m, for example. In such a case, it is preferable that a plurality of covered electrical wires having a length of less than 20 m are collected such that a central elemental wire has a total length of 20 m or more, and a conductor is taken out from each covered electrical wire, and the total amount of oil adhering to the central elemental wire is measured. Covered electrical wires to be collected need to at least include conductors whose specifications (the compositions of elemental wires, the number of elemental wires in a twisted wire, an average cross-sectional area of elemental wires, outer diameters of conductors, and the like) are regarded as substantially the same.

Oxide Film

When the surface of each elemental wire 20 contains copper oxide including an electrical insulating material, such as CuO, in a small amount, in a case where a terminal portion is fixed to the conductor 2 through crimping, for example, contact resistance between the conductor 2 and the terminal portion can be reduced. It is preferable that, quantitatively, the covered electrical wire includes a coating film made of copper oxide on the surface of an elemental wire 20, and the coating film has a thickness of 10 nm or less. Here, if heat treatment is performed in a manufacturing process as described above, a coating film made of copper oxide is formed on a surface of the elemental wires 20 constituted by a copper alloy. Normally, copper oxide that forms the above-described coating film includes CuO and $Cu_2O$, and thus, the thinner the coating film is, the smaller the amount of the electrical insulating material included in the coating film is, and the further the contact resistance between the conductor 2 and the terminal portion can be reduced. Thus, the above-described coating film preferably has a thickness of 9.5 nm or less, 8 nm or less, and 5 nm or less. Although, desirably, the above-described coating film is not present (the thickness thereof is 0 nm), considering practical workability during heat treatment and the like, the above-described coating film may have a thickness of 0.05 nm or more, and 0.08 nm or more. A method for measuring the thickness of the above-described coating film will be described later.

When the central elemental wire 21 and the outer peripheral elemental wires 22 are made of a copper alloy having the same composition, these elemental wires 21 and 22 may be manufactured under the same manufacturing conditions. In this case, the thickness of the coating film made of copper oxide formed on the central elemental wire 21 and the thickness of the coating film made of copper oxide formed on the outer peripheral elemental wires 22 may substantially be equal to each other. However, when the insulating coating layer 3 is removed from the covered electrical wire 1 when the thickness of the above-described coating film is to be measured, the surface of an outer peripheral elemental wire 22 may be damaged, and the thickness of the coating film made of copper oxide possibly cannot be appropriately measured. In view of this, possibly, measurement of the thickness is preferably performed on the central elemental wire 21 that is not in contact with the insulating coating layer 3.

As described above, when the coating film made of copper oxide has a thickness of 10 nm or less, even if the degree of compression is reduced when the terminal portion is fixed to an end portion of the covered electrical wire 1 through crimping, contact resistance can be reduced. With the covered electrical wire 1, a greater remaining area ratio of a compressed portion of the conductor 2 where the terminal portion is compressed can be secured as a result of making the above-described degree of compression smaller, and good characteristics of an uncompressed portion of the conductor 2 can be easily maintained. Such a covered electrical wire 1 contributes to the construction of a terminal-equipped electrical wire 10 (FIG. 3) having good characteristics such as impact resistance.

An example of a method for reducing the thickness of the copper oxide coating film is controlling an atmosphere in a case where heat treatment such as aging or softening is performed. Details thereof will be described later.

Surface Roughness

It was found that, when the surface of each elemental wire 20 is smooth, if a branch line or the like is to be welded to the conductor 2, the branch line and the conductor 2 can be easily brought into contact with each other before welding is performed, and welded to each other accurately, and as a result of which, weld strength can be increased. Also, when the surface of each elemental wire 20 is smooth, oil content is unlikely to remain in recessed portions of the surface, and it is expected that the oil adhering amount can be easily reduced. It is preferable that, quantitatively, the surface roughness Ra of the central elemental wire 21 and the surface roughness Ra of the outer peripheral elemental wires 22 is 0.05 μm or less. Because the smaller the surface roughness Ra is, the more likely the weld strength is to increase, the surface roughness Ra is 0.04 μm or less, and more preferably 0.035 μm or less. Also, it is preferable that a difference between the surface roughness Ra of the central elemental wire 21 and the surface roughness Ra of the outer peripheral elemental wires 22 is small, specifically, the difference therebetween is 0.005 μm or less, and 0.004 μm or less. Here, if the conductor 2 is a compressed twisted wire, there may be cases where the surface roughness Ra of the outer peripheral elemental wires 22 is smaller than that of the central elemental wire 21 due to the outer peripheral elemental wires 22 undergoing plastic deformation as a result of compression molding (see test examples that will be described later). Even if the surface of the outer peripheral elemental wires 22 is smooth, if the surface of the central elemental wire 21 is rough, weld strength may decrease (see the test examples). Thus, it is preferable that the surfaces of all of the elemental wires 20 constituting the conductor 2 are smooth. A method for measuring the surface roughness Ra will be described later. The surface roughness Ra here conforms to JIS B 0601 (2013).

An example of the method for reducing the above-described surface roughness Ra is utilization of a wire drawing die that is used in wiredrawing or the like and has an inner circumferential surface having a small surface roughness Ra of 0.05 μm or less, for example. If the surface roughness of a wire drawing material is used as an alternative value, for example, the surface roughness of a wire drawing die can be easily measured.

Cross-Sectional Area

The cross-sectional area of the conductor 2 (the total cross-sectional area of the elemental wires 20 constituting a twisted wire) can be selected as appropriate according to applications of the covered electrical wire 1. In particular, when the above-described cross-sectional area thereof is 0.22 $mm^2$ or less, a lightweight covered electrical wire 1 can be obtained. Such a covered electrical wire 1 can be suitably used for applications in which a reduction in weight is desired, such as a wire harness for an automobile, for example. Considering a further reduction in weight, the above-described cross-sectional area may be 0.2 $mm^2$ or less, 0.15 $mm^2$ or less, and 0.13 $mm^2$ or less.

It is preferable to select the cross-sectional area, the shape, and the like of each pre-twisting elemental wire 20, such that the cross-sectional area of the conductor 2 has a predetermined size. Although the pre-twisting elemental wires 20 may include elemental wires 20 having different cross-sectional areas and shapes, if the elemental wires 20 have the same cross-sectional area and the same shape, twisting conditions can be easily adjusted.

Twisted State

Number of Elemental Wires Etc.

The number of elemental wires of a twisted wire constituting the conductor 2 can be selected as appropriate, and may be 7, 19, or 37, for example, and the central elemental wire 21 may be constituted by two or more wires. In the 7-twisted wire shown in FIG. 1, the outer periphery of one central elemental wire 21 is provided with one outer peripheral layer constituted by six outer peripheral elemental wires 22. A 19-twisted wire includes two outer peripheral layers, and a 37-twisted wire includes three outer peripheral layers.

Compression Ratio of Twisted Wire

If a twisted wire constituting the conductor 2 is an uncompressed twisted wire (see FIG. 1) in which the elemental wires 20 are just twisted, a compression molding process can be eliminated. Alternatively, if a twisted wire constituting the conductor 2 is a compressed twisted wire (see FIG. 2) obtained through compression molding after twisting together elemental wires, the following effects are obtained.

The outer diameter of the twisted wire can be made smaller than that of an uncompressed twisted wire, and a covered electrical wire 1 having a smaller diameter can be obtained.

A cross-sectional shape can be a desired shape such as a circle.

The insulating coating layer 3 can be easily formed.

An increase in strength through work hardening during compression forming can be expected.

Thus, it is possible to obtain a covered electrical wire 1 that is less likely to buckle, and a covered electrical wire 1 having higher weld strength. Note that the cross-section of the conductor 2 refers to a cross-section obtained by cutting the conductor 2 along a plane orthogonal to the longitudinal direction of the conductor 2.

When the ratio of the cross-sectional area that has decreased through compression molding to the total cross-sectional area of the pre-twisting elemental wires 20 (e.g., the total area of seven elemental wires 20 in the case of a 7-twisted wire), that is, {(the total cross-sectional area of pre-twisting elemental wires−the cross-sectional area of a compressed twisted wire)/the total cross-sectional area of pre-twisting elemental wires}×100, is a compression ratio (%) of a compressed twisted wire, the higher the compression ratio is, the more likely the strength is to increase. Note that, if the above-described compression ratio is too high, there is a possibility that toughness such as breaking elongation will decrease, or impact resistance will decrease, or it will be difficult to crimp a terminal portion. Also, the above-described compression ratio may affect the surface roughness of an elemental wire (see test examples, which will be described later), for example, if the compression ratio is too high, the surface roughness of elemental wires disposed on the outer peripheral side significantly decreases, and a difference between the surface roughness Ra of an elemental wire disposed on the inner side and the surface roughness Ra of an elemental wire disposed on the outer peripheral side is likely to increase. As a result of surface roughness of an inner elemental wire being relatively large, weld strength may decrease. Considering an increase in strength, ensuring toughness and impact resistance, an increase in weld strength, and the like, a compressed twisted wire preferably has a compression ratio of 10% to 30% inclusive, and may have a compression ratio of 12% to 25% inclusive, and 12% to 20% inclusive. The compression ratio may be preset in a manufacturing process, and the above-described range can be achieved by performing compression molding based on the set value. Note that, depending on the compressed state, the above-described compression ratio of the compressed twisted wire can sometimes be easily measured, presuming that the cross-sectional area of an envelope circle x the number of elemental wires is the total cross-sectional area of pre-twisting elemental wires where the envelope circle is the smallest envelope circle that includes the central elemental wire 21, out of the elemental wires 20 constituting the conductor 2.

Twist Pitch

A twist pitch of the twisted wire constituting the conductor 2 (the twist pitch of an outer peripheral elemental wire 22) can be selected as appropriate according to the cross-sectional area of the conductor 2, for example. When the conductor 2 has a small cross-sectional area, in particular, if the conductor 2 has a cross-sectional area of 0.22 $mm^2$ or less, if the twisted wire has a somewhat long twist pitch, in particular, has a twist pitch of 12 mm or more, and 14 mm or more, a covered electrical wire 1 that has higher strength and is unlikely to buckle can be obtained. The longer the twist pitch is, the more likely the strength is to increase, and the twist pitch may be 14.5 mm or more, 15 mm or more, and 15.5 mm or more. If the twist pitch is too long, although elemental wires 20 can easily slide against each other and bending or the like can be easily performed, the elemental wires 20 may be unlikely to move as a whole, and be likely to buckle. Thus, when the conductor 2 has a cross-sectional area of 0.22 $mm^2$ or less, the twist pitch is preferably 20 mm or less, and more preferably 16 mm or less.

Figure 5:
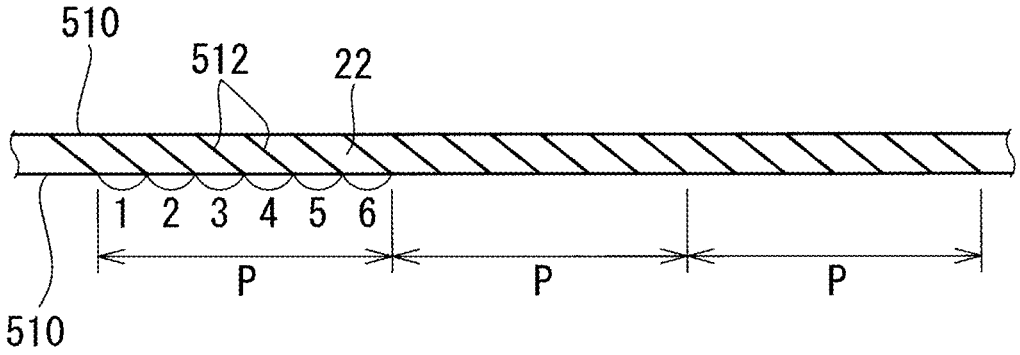
FIG. 5 is a diagram illustrating a method for measuring a twist pitch of a twisted wire constituting a conductor provided in a covered electrical wire.

The above-described twist pitch may be preset in a manufacturing process, and the above-described range can be achieved by twisting together a plurality of elemental wires 20 based on the set value. Note that measurement of a twist pitch of the conductor 2 provided in the covered electrical wire 1 is made as follows. A covered electrical wire 1 having a predetermined length (e.g., 100 mm or more) is prepared, and the conductor 2 is exposed by removing the insulating coating layer 3 using an appropriate cutting tool such as a feather in a state in which two ends of the covered electrical wire 1 are fixed. Thin paper such as Japanese paper or tracing paper is placed on an exposed portion of the conductor 2, and twisting grooves and an outer circumferential edge extending in the axial direction of the conductor are traced using a pencil or the like. As illustrated in FIG. 1, in the 7-twisted wire in which the number of outer peripheral elemental wires 22 is six, as shown in FIG. 5, two outer circumferential edges 510 and 510 are disposed in parallel to each other, and twisting grooves 512 are indicated using oblique lines (typically, darkly traced lines) that intersect the outer circumferential edges 510. A space between adjacent twisting grooves 512 and 512 indicates one outer peripheral elemental wire 22. A length P of every six-outer peripheral elemental wires 22 (every seven-twisting grooves 512) along the outer circumferential edges 510 is measured using a ruler or the like. A twist pitch is obtained through measurement of the lengths P where n is equal to 3 (n=3) and averaging the lengths P where n is equal to 3. The above-described length P can also be measured by taking a photograph of the above-described exposed portion of the conductor 2 and using the photograph (image). The twist pitch measured in this manner is substantially equal to the above-described set value in the manufacturing process.

Shape

Figure 2:
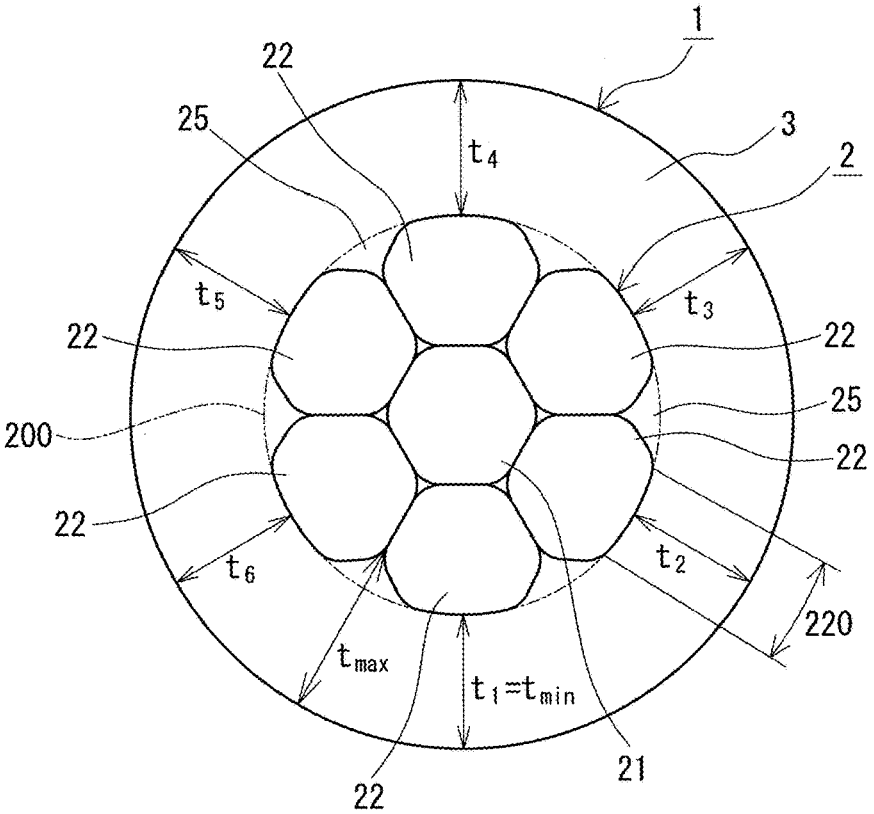
FIG. 2 is a schematic front view showing an example of an end surface of the covered electrical wire according to an embodiment.

The outer shape of the conductor 2 is a shape corresponding to the twisted state (See FIGS. 1 and 2). Exemplary examples of a compressed twisted wire include twisted wires whose cross-sectional shape or end surface shape is similar to a circle (see FIG. 2). In addition, as a result of appropriately selecting the shape of a mold used in compression molding, the cross-sectional shape thereof may be an elliptical shape or a polygonal shape such as a hexagonal shape, for example.

Characteristics

Depending on the composition and the manufacturing conditions of the conductor 2, the conductor 2 may have at least one of a tensile strength of 450 MPa or more, a breaking elongation of 5% or more, and an electrical conductivity of 55% IACS or more. When the conductor 2 has a tensile strength of 450 MPa or more, the conductor 2 has high strength and is unlikely to buckle. Also, the conductor 2 has good weld strength. When the conductor 2 has a breaking elongation of 5% or more, the conductor 2 can be easily bent. When the conductor 2 has an electrical conductivity of 55% IACS or more, the conductivity is good, and the cross-sectional area of the conductor 2 can be more easily reduced. In particular, it is preferable that the conductor 2 has a tensile strength of 450 MPa or more and has a breaking elongation of 5% or more, because the conductor 2 has high strength and toughness, and has better impact resistance. It is more preferable that all three listed items are satisfied.

If higher strength is needed, the conductor 2 may have a tensile strength of 460 MPa or more, 465 MPa or more, 470 MPa or more, and 500 MPa or more.

If higher toughness is needed, the conductor 2 may have a breaking elongation of 6% or more, 7% or more, 8% or more, and 10% or more.

If higher electrical conductivity is needed, the conductor 2 may have an electrical conductivity of 60% IACS or more, 65% IACS or more, and 70% IACS or more.

Typically, tensile strength, breaking elongation, and electrical conductivity can be set to predetermined values by adjusting the composition and manufacturing conditions of a copper alloy. If the amount of an additive element is increased or elemental wires 20 having a smaller diameter are used at a higher wiredrawing degree, for example, the tensile strength is likely to increase and electrical conductivity is likely to decrease. If the heat treatment temperature is increased when heat treatment is performed, for example, the breaking elongation is likely to increase and the tensile strength is likely to decrease. If aging is performed on a precipitation copper alloy, the electrical conductivity is likely to increase.

Insulating Coating Layer

Constituent Material

Examples of an insulating material constituting the insulating coating layer 3 include materials having good flame retardancy, such as polyvinyl chloride (PVC) and halogen-free resins (e.g., polypropylene (PP)). PVC is relatively soft, and it is possible to obtain a covered electrical wire 1 that can be easily bent. A halogen-free resin is relatively hard, and it is possible to obtain a covered electrical wire 1 that is unlikely to buckle even if the insulating coating layer 3 is relatively thin. A known insulating material can be used as the above-described insulating material.

Thickness

The thickness of the insulating coating layer 3 can be selected as appropriate according to the cross-sectional area of the conductor 2 or the like, as long as the insulating coating layer 3 has a predetermined insulating strength. In particular, if the conductor 2 has a cross-sectional area of 0.22 $mm^2$ or less, the insulating coating layer 3 preferably has an average thickness of 0.21 mm or more, has an average thickness of 0.22 mm or more, and more preferably has an average thickness of 0.23 mm or more. This is because a thick insulating coating layer 3 makes it possible to improve the rigidity of the covered electrical wire 1, thus making the covered electrical wire 1 less likely buckle. As shown in FIG. 2, the average thickness refers to the average of thicknesses $t_n$ (the sum of thicknesses $t_n$/the number of outer peripheral elemental wires) when the minimum distance between the outer circumferential surface of the insulating coating layer 3 and a crown portion 220, excluding the twisting groove 25 formed at a portion where outer circumferential surfaces of adjacent outer peripheral elemental wires 22 and 22 face each other, of outer circumferential surfaces of the outer peripheral elemental wires 22 that are disposed on the outermost side of the twisted wire that constitutes the conductor 2 is the thickness $t_n$. In the 7-twisted wire, the average thickness refers to the average $((t_1+t_2+\ldots+t_6)/6)$ of thicknesses $t_1$ to $t_6$ that correspond to six outer peripheral elemental wires 22. Simply, the above-described average thickness corresponds to an average distance between the smallest envelope circle 200 that includes the conductor 2 and the outer circumferential surface of the insulating coating layer 3.

The insulating coating layer 3 is preferably formed on the conductor 2 at an even thickness. This is because integration of the conductor 2 and the insulating coating layer 3 makes it possible to easily increase rigidity and makes the conductor 2 less likely buckle. Quantitatively, a ratio of the minimum value of the above-described thickness $t_n$ to the maximum value of the thickness $t_n$ (referred to as a "thickness uniformity ratio" hereinafter) may be 80% or more. The above-described thickness uniformity ratio is preferably 80.5% or more, and more preferably 82% or more because the larger the uniform thickness ratio is, the more uniform the thickness of the insulating coating layer 3 is, and the less the conductor is likely to buckle. It is most preferable that all thicknesses to are equal to each other, that is, the above-described thickness uniformity ratio is 100%. Note that, if the above-described thickness uniformity ratio is high, it can be said that the axis of the conductor 2 and the axis of the insulating coating layer 3 are almost coaxial, and that the degree of eccentricity of the insulating coating layer 3 with respect to the conductor 2 is small.

Because the insulating coating layer 3 is formed along the outer periphery of the twisted wire that constitutes the conductor 2, the thickness of a portion that fills a twisting groove 25 is larger than the thickness of a portion covering the crown portion 220. Typically, the thickness of the portion covering the twisting groove 25 is the maximum thickness $t_{max}$, and the thickness of the portion covering the crown portion 220 is the minimum thickness $t_{min}$. In FIG. 2, $t_1$ indicates the minimum thickness $t_{min}$. In the insulating coating layer 3, if the ratio of the minimum thickness $t_{min}$ to the maximum thickness $t_{max}$ ($t_{min}/t_{max}$, which will be referred to as a thickness ratio hereinafter) is too small, the thickness of a portion covering the crown portion 220 is too small, and thus it is difficult to increase rigidity. From the viewpoint of making the conductor less likely buckle, the above-described thickness ratio is preferably 0.6 to 0.9 inclusive, 0.61 to 0.88 inclusive, and 0.62 or more and less than 0.85.

Applications

The covered electrical wire 1 according to this embodiment can be used for various types of wiring. In particular, the covered electrical wire 1 is suitable for applications used in a state in which a terminal portion is attached to an end portion of the covered electrical wire 1. Specifically, the covered electrical wire 1 can be used for wiring in various electrical devices such as devices of automobiles and airplanes etc., and control devices of industrial robots etc., for example, wiring in various wire harnesses such as wire harnesses for automobiles.

Terminal-Equipped Electrical Wire

Figure 3:
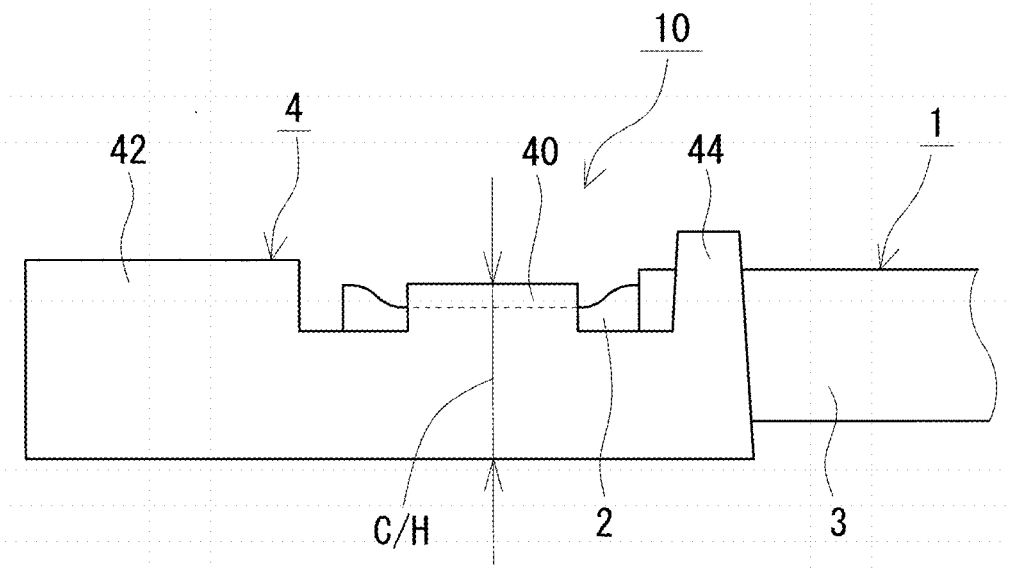
FIG. 3 is a schematic side view showing the vicinity of a terminal portion, with regard to a terminal-equipped electrical wire according to an embodiment.

As shown in FIG. 3, the terminal-equipped electrical wire 10 of this embodiment includes the covered electrical wire 1 of this embodiment, and a terminal portion 4 attached to an end portion of the covered electrical wire 1. FIG. 3 shows a crimp terminal as an example, the crimp terminal including, as the terminal portion 4, a female or male fitting portion 42 at one end thereof, an insulation barrel portion 44 for holding the insulating coating layer 3 on the other end thereof, and a wire barrel portion 40 for holding the conductor 2 at an intermediate portion thereof. The crimp terminal is crimped to the end portion of the conductor 2 that is exposed by removing the insulating coating layer 3 at the end portion of the covered electrical wire 1, and is electrically and mechanically connected to the conductor 2. Another example of the terminal portion 4 is a melting type that is connected thereto by melting the conductor 2.

Examples of a mode of the terminal-equipped electrical wire 10 include a mode in which one terminal portion 4 is attached to each covered electrical wire 1 (FIG. 3) and a mode in which a plurality of covered electrical wires 1 include one terminal portion 4. If a plurality of covered electrical wires 1 are bundled using a binding tool or the like, the terminal-equipped electrical wire 10 can be handled with ease.

If the terminal portion 4 to be provided in the terminal-equipped electrical wire 10 is a crimp terminal, when the ratio of the cross-sectional area of a compressed portion of the conductor 2 to which the terminal portion 4 is attached to the cross-sectional area of an uncompressed portion of the conductor 2 to which the terminal portion 4 is not attached is a remaining area ratio, the remaining area ratio is high, and the terminal-equipped electrical wire 10 has better characteristics such as impact resistance, even if the cross-sectional area of the conductor 2 is small as described above. Quantitatively, the above-described remaining area ratio may exceed 0.76. The higher the remaining area ratio is, the more the compressed portion of the conductor 2 where the terminal portion 4 is compressed is likely to maintain the good characteristics of the uncompressed portion of the conductor 2, and the terminal-equipped electrical wire 10 has better impact resistance overall. Considering an improvement in impact resistance and the like, the above-described remaining area ratio may be 0.77 or more, 0.78 or more, 0.79 or more, and 0.80 or more.

The above-described remaining area ratio satisfies the above-described range as a result of adjusting the degree of compression applied when attaching the terminal portion 4, in particular, reducing the degree of compression, and, typically, adjusting the crimp height (C/H, the height of the wire barrel portion 40 in the terminal-equipped electrical wire 10). Because, as described above, the terminal-equipped electrical wire 10 of this embodiment includes, as constituent elements, a covered electrical wire 1 in which a twisted wire having a small oil adhering amount is used as the conductor 2, even if the degree of compression is small as described above, contact resistance between the conductor 2 and the terminal portion 4 can be reduced (see test examples, which will be described later).

The uncompressed portion of the conductor 2 in the terminal-equipped electrical wire 10 of this embodiment maintains the specifications (the composition, structure, surface properties, twisted state, shape, characteristics, and the like) of the conductor 2 provided in the covered electrical wire 1 of the above-described embodiment, or has characteristics and the like that are substantially equal thereto. Details thereof are as described above.

Applications

The terminal-equipped electrical wire 10 of this embodiment can be used for the above-described wiring in various electrical devices such as devices of automobiles and airplanes, and control devices, and in particular, wiring in various wire harnesses such as wire harnesses for automobiles.

Wire Welding Structure

In the covered electrical wire 1 of this embodiment and the terminal-equipped electrical wire 10 of this embodiment, a branch can be formed by welding a branch line or the like to a portion of the conductor 2. In this case, as described above, the oil adhering amount of the conductor 2 is small, and thus a conversion product resulting from oil content or the like is unlikely to be present at a welding portion, and thus the conductor 2 has good weld strength. The branch line may have the same configuration as the covered electrical wire 1 of this embodiment and the terminal-equipped electrical wire 10 of this embodiment. Another example of the covered electrical wire is a covered electrical wire provided with, as another branch line, a copper conductor constituted by pure copper. It is possible to construct a wire welding structure in which the wire includes a welding portion where the covered electrical wire 1 of this embodiment or the terminal-equipped electrical wire 10 of this embodiment, a covered electrical wire for branching provided with a copper conductor constituted by pure copper, an exposed portion of the conductor 2 that is exposed from the insulating coating layer 3, and a portion of the copper conductor are welded to each other, for example. Generally, pure copper has lower strength than that of a copper alloy. Thus, in this electrical wire welding structure, if the cross-sectional area of the copper conductor is made larger than that of the conductor 2 constituted by a copper alloy, strength of the welding portion can be easily increased. Also, if the copper alloy constituting the conductor 2 includes the above-described precipitates, as described above, as a result of forming a structure having a small number of coarse precipitates, the structure is close to a structure of pure copper in which no precipitates are substantially present, and thus welding can be easily performed, and bond strength can be easily increased.

Effects

The covered electrical wire 1 of this embodiment and the terminal-equipped electrical wire 10 of this embodiment exhibit special effects that the covered electrical wire 1 and the terminal-equipped electrical wire 10 are unlikely to buckle, has low contact resistance between the conductor 2 and the terminal portion 4, and has good weld strength in a case where a branch line or the like is welded thereto, because they each include the conductor 2 in which elemental wires 20 are concentrically twisted together, and the amount of oil adhering to the surfaces of the elemental wires 20 is in a specific range. These effects will be described specifically in test example 1, which will be described later.

Method for Manufacturing Covered Electrical Wire

The covered electrical wire 1 of this embodiment can be manufactured using, typically, a manufacturing method including a process for preparing the conductor 2 constituted by a copper alloy and a process for forming the insulating coating layer 3 on the outer periphery of the conductor 2. A known manufacturing method for manufacturing a covered electrical wire provided with a twisted wire conductor and an insulating coating layer covering the outer periphery of this conductor can be referred to for basic manufacturing conditions and the like. The conductor 2 is a twisted wire obtained by concentrically twisting together a plurality of elemental wires 20 made of a copper alloy.

Elemental Wire

Each elemental wire 20 can be manufactured using, typically, a manufacturing method including a process for casting a copper alloy, a process for performing plastic forming such as rolling and conform extrusion on a cast material, and a process for wiredrawing a plastically formed material. Various types of continuous casting can be used for casting. A continuous cast-rolling material that is to be rolled following continuous casting can be used for wiredrawing. Heat treatment can be performed during or after wiredrawing as appropriate. A known copper alloy wire manufacturing method can be referred to for basic manufacturing conditions and the like.

If an appropriate lubricant is used during wiredrawing, wire breakage is unlikely to occur, and good wire drawability can be obtained. If this lubricant is applied in a small amount, for example, the above-described oil adhering amount can satisfy the above-described specific range. Regardless of the presence or absence of adjustment of the above-described application amount thereof, oil content can be actively reduced or removed through heat treatment. In addition, if a wire drawing die whose inner circumferential surface has a small surface roughness Ra (details have been described above) is used, the surface roughness Ra of an elemental wire 20 can be in the above-described specific range.

If heat treatment is performed during or after wiredrawing, wire drawability can be increased, and elemental wires can be easily twisted, for example, thus increasing manufacturability of a wire drawing material (the elemental wire 20) or a twisted wire (the conductor 2).

Twisted Wire

Out of the prepared multiple elemental wires 20, one or more elemental wires are used as the central elemental wire 21, and a plurality of outer peripheral elemental wires 22 are twisted around the outer periphery of the central elemental wire 21 at a predetermined twist pitch (details have been described above). When the twist pitch is somewhat long as described above, even if the conductor 2 has a small cross-sectional area, strength of a twisted wire can be easily increased, and a covered electrical wire 1 that is unlikely to buckle can be easily manufactured. After twisting is performed, compression molding is performed at a predetermined compression ratio (details have been described above) to prepare a compressed twisted wire having a predetermined shape. It is preferable to adjust the compression ratio in a range where the cross-sectional area of the conductor 2 satisfies a predetermined size (details have been described above). Setting the compression ratio in the above-described specific range makes it possible to expect an increase in strength while suppressing a decrease in toughness and a decrease in impact resistance.

It is expected that, although it depends on the composition of a copper alloy, as a result of performing heat treatment such as aging and softening on the pre-twisting elemental wires 20, a twisted wire with the elemental wires 20 twisted together, or a compressed twisted wire, strength will increase due to dispersion of precipitates being strengthened (precipitation alloy), electrical conductivity will increase due to a reduction in the amount of a solid-solution element (precipitation alloy, solid-solution alloy), and elongation and impact resistance will increase through softening (precipitation alloy, solid-solution alloy), for example. As a result of performing heat treatment for the purpose of aging or softening, oil content can be reduced, and a covered electrical wire 1 in which the above-described oil adhering amount satisfies 10 μg/g or less can be easily manufactured in some cases. Alternatively, if heat treatment for reducing or removing the oil content is separately performed according to the above-described amount of the applied lubricant, a covered electrical wire 1 in which the above-described oil adhering amount satisfies 10 μg/g or less can be easily manufactured.

Examples of the heat treatment conditions for the purpose of aging and softening for the above-described compositions (1) and (2) are as follows.

Composition (1) heat treatment temperature: 400° C. to 650° C. inclusive, and 450° C. to 600° C. inclusive, holding time period: 1 hour to 40 hours inclusive, and 4 hours to 20 hours inclusive.

Composition (2) heat treatment temperature: 350° C. to 550° C. inclusive, and 400° C. to 500° C. inclusive, holding time period: 1 hour to 40 hours inclusive, and 4 hours to 20 hours inclusive.

In order to reduce or remove the above-described oil content, degreasing is performed on a twisted wire or a compressed twisted wire, for example. It is desired that the degreasing liquid is a solution containing an alcohol-based component.

It is preferable that an atmosphere of the above-described heat treatment is an atmosphere having a low oxygen concentration because oxidation of the surfaces of the elemental wires 20 can be easily prevented, and a copper oxide coating film can be made thinner. Quantitatively, an example thereof is an atmosphere in which the oxygen content is 0.1 vol % or less. Examples of such a low oxygen atmosphere include a reducing atmosphere, inert atmosphere, and reduced-pressure atmosphere. Examples of the reducing atmosphere include an atmosphere constituted by substantially only reducing gas, and an atmosphere constituted by substantially gas mixture of reducing gas and inert gas. Examples of reducing gas include hydrogen and carbon monoxide. Examples of inert gas include nitrogen and argon. An example of the reduced-pressure atmosphere is an atmosphere with 10 Pa or less. There are cases where, depending on the composition, it is preferable to reduce the oxygen content, for example, reducing the oxygen content to 10 ppm by volume or less.

Insulating Coating Layer

The insulating coating layer 3 may be formed using an extrusion method, or the like. When the insulating coating layer 3 is formed, if a twisted wire is heated, the twisting groove 25 may be easily filled with a molten resin, or a molten resin may easily adhere to the outer periphery of the twisted wire at an even thickness. As a result, as described above, the covered electrical wire 1 in which the insulating coating layer 3 has a high thickness uniformity ratio, or the covered electrical wire 1 in which the thickness ratio is in a specific range can be easily manufactured. In particular, even if the average thickness of the insulating coating layer 3 is relatively large at 0.21 mm or more, the covered electrical wire 1 in which the insulating coating layer 3 has a high thickness uniformity ratio, and the thickness ratio is in a specific range can be easily manufactured. A twisted wire heating temperature may be the temperature of a molten resin ±10° C., or preferably, may substantially be equal to the temperature of a molten resin, for example. Note that it is expected that the above-described oil adhering amount decreases through heating. Also, the above-described copper oxide coating film is unlikely to be thick at this heating temperature.

Method for Manufacturing Terminal-Equipped Electrical Wire

The terminal-equipped electrical wire 10 of this embodiment can be manufactured using a manufacturing method including a process for exposing an end portion of the conductor 2 by removing the insulating coating layer 3 located on at least one end side of the covered electrical wire 1, and a process for attaching the terminal portion 4 to the end portion of the conductor 2. If the terminal portion 4 is a crimp terminal, crimping is performed to a predetermined crimp height (C/H). At this time, it is preferable to adjust C/H such that the remaining area ratio of the conductor 2 (details have been described above) is somewhat increased as described above.

Test Example 1

Copper alloy wires were used as elemental wires to produce a twisted wire in which the elemental wires are concentrically twisted together, a covered electrical wire in which this twisted wire is used as a conductor was produced, a terminal portion was attached to an end portion thereof, and a buckling state thereof and contact resistance to the terminal portion were examined. Also, a copper conductor was welded to the above-described covered electrical wire, and weld strength was examined.

Production of Samples

The copper alloy wire used as an elemental wire was produced as a result of cold-rolling a continuous cast material produced using a molten copper alloy and wiredrawing the obtained rolled material, or wiredrawing a continuous cast rolling material produced using a molten copper alloy. After the obtained copper alloy wires were twisted together, a compressed twisted wire was produced through compression molding. Heat treatment is performed on the compressed twisted wire as appropriate. Alternatively, after heat treatment was performed on the copper alloy wire (wire drawing material) and the resulting elemental wires were twisted together, compression molding was performed. The composition of a copper alloy of each sample (the remaining portion includes Cu and inevitable impurities) and the process for manufacturing each sample are shown in Table 1. With regard to samples on which heat treatment was performed, the heat treatment temperature (° C.) and the holding time period (time) are also shown in Table 1. The heat treatment atmosphere was a reducing atmosphere mainly containing hydrogen (the oxygen content was 0.1% by volume or less).

TABLE 1

| Sample No. | Composition (mass %) Fe | Ti | P | Mg | Sn | Bal. | Manufacturing Conditions |
|---|---|---|---|---|---|---|---|
| 1-1 | 1.05 | 0.45 | — | 0.05 | — | Cu | continuous casting → cold rolling → wiredrawing → twisting and compression → heat treatment at 540° C. for 8 hrs. |
| 1-2 | 0.98 | 0.4 | — | 0.05 | — | Cu | continuous casting → cold rolling → wiredrawing → twisting and compression → heat treatment at 540° C. for 8 hrs. |
| 1-3 | — | — | — | — | 0.28 | Cu | continuous cast-rolling → wiredrawing → twisting and compression |
| 1-4 | 0.61 | — | 0.12 | — | 0.26 | Cu | continuous casting → cold rolling → wiredrawing → twisting and compression → heat treatment at 450° C. for 8 hrs. |
| 1-5 | — | — | — | 0.14 | — | Cu | continuous cast-rolling → wiredrawing → twisting and compression |
| 1-6 | 0.57 | — | 0.13 | — | 0.31 | Cu | continuous casting → cold rolling → wiredrawing → twisting and compression → heat treatment at 440° C. for 8 hrs. |
| 1-7 | 0.47 | — | 0.2 | 0.03 | 0.21 | Cu | continuous casting → cold rolling → wiredrawing → twisting and compression → heat treatment at 470° C. for 8 hrs. |
| 1-101 | — | — | — | — | 0.1 | Cu | continuous cast-rolling → wiredrawing → heat treatment at 400° C. for 3 hrs. → twisting and compression |
| 1-102 | 1.1 | 0.5 | 0.05 | — | — | Cu | continuous casting → cold rolling → wiredrawing → twisting and compression → heat treatment at 570° C. for 8 hrs. |
| 1-103 | 1.05 | 0.5 | — | — | — | Cu | and continuous casting → cold rolling → wiredrawing → twisting compression → heat treatment at 570° C. for 8 hrs. |
| 1-104 | 0.41 | — | 0.2 | — | — | Cu | continuous casting → cold rolling → wiredrawing → twisting and compression → heat treatment at 500° C. for 8 hrs. |
| 1-105 | 0.6 | — | 0.12 | — | — | Cu | continuous casting → cold rolling → wiredrawing → twisting and compression → heat treatment at 470° C. for 8 hrs. |

With Samples No. 1-1 to No. 1-7, a wire drawing die whose inner circumferential surface has a surface roughness Ra of 0.05 μm or less was used. With Samples No. 1-101 to No. 1-105, a wire drawing die whose inner circumferential surface has a surface roughness Ra of more than 0.05 μm was used. Wiredrawing was performed on all of the samples using a lubricant.

For each sample, seven copper alloy wires having a wire diameter of 0.12 to 0.16 mm were prepared, a twisted wire in which seven elemental wires were concentrically twisted together was produced by twisting, at a twist pitch (mm) shown in Table 2, together outer peripheral elemental wires around the outer periphery of a central elemental wire where one of the seven wires was a central elemental wire and the other six wires were the outer peripheral elemental wires. A compressed twisted wire in which a conductor had a cross-sectional area ($mm^2$) shown in Table 2 and the cross-sectional shape thereof was a circular shape was produced through compression molding at a compression ratio (%) shown in Table 2 after twisting was performed. The above-described compression ratio (%) was obtained using {(the total cross-sectional area of the seven pre-twisting elemental wires is performed−the cross-sectional area of the compressed twisted wire)/the total cross-sectional area of the seven pre-twisting elemental wires is performed}×100. Note that, when the twist pitch of the twisted wire for a conductor provided in a covered electrical wire of each sample that was ultimately obtained was measured as described in the above-described item "Twist pitch", it was confirmed that the measured values were substantially equal to the values shown in Table 2.

An insulating coating layer made of a constituent material shown in Table 2 was formed on the outer periphery of the prepared conductor through extrusion such that the formed insulating coating layer had a thickness (mm) shown in Table 2. In Table 2, PVC refers to polyvinyl chloride, and HF (PP) refers to halogen-free polypropylene. In Table 2, the thickness of an insulating coating layer refers to the average of thicknesses of a portion covering the above-described crown portion (see $t_1$ to $t_6$ in FIG. 2). Note that, when the average thickness of an insulating coating layer for a covered electrical wire of each sample that was ultimately obtained was measured as described in the above-described item "Thickness", it was confirmed that the measured values were substantially equal to the values shown in Table 2.

With Samples No. 1-1 to No. 1-7, No. 1-101, and No. 1-103, an insulating coating layer was formed in a state in which a conductor was heated at a temperature selected from the temperature of a molten resin±10° C. With Samples No. 1-102, No. 1-104, and No. 1-105, an insulating coating layer was formed in a state in which the temperature of a conductor was kept at normal temperature (about 20° C. here).

Characteristics of Conductor and the Like

With regard to a covered electrical wire of each of the prepared samples, the amount (μg/g) of oil adhering to a surface of a central elemental wire of a twisted wire constituting a conductor was measured as described below. Results thereof are shown in Table 2.

A covered electrical wire was cut to a predetermined length (e.g., 20 m here), and a conductor was exposed by removing the insulating coating layer using an appropriate cutting tool such as a feather. An outer peripheral elemental wire of a twisted wire constituting the conductor was removed to undo twists thereof, and only a central elemental wire was taken out. At this time, the surface of the central elemental wire was prevented from being scratched, oil content or the like of an operator's hand was prevented from adhering to the central elemental wire, and oil content of the central elemental wire was prevented from adhering to an operator's hand. The mass (g) of the central elemental wire taken out was measured. The central elemental wire was immersed in a solvent to dissolve the oil content thereof in the solvent. The mass (u) of oil content dissolved in the solvent was measured using an oil content analyzer, and the amount of oil content in 1 g of a central elemental wire (μg/g) was measured by dividing the mass (μg) of the measured oil content by the mass (g) of the central elemental wire (the mass of oil content/the mass of the central elemental wire). Here, a commercially available apparatus and solvent were used as an oil content analyzer (OCMA-305 manufactured by HORIBA, Ltd., solvent: H-997, which is alternative hydrochlorofluorocarbon).

With regard to a covered electrical wire of each of the prepared samples, the thickness (nm) of a coating film made of copper oxide that might be present on the surface of elemental wires constituting a conductor was measured as described below. Results thereof are shown in Table 2.

Figure 4:
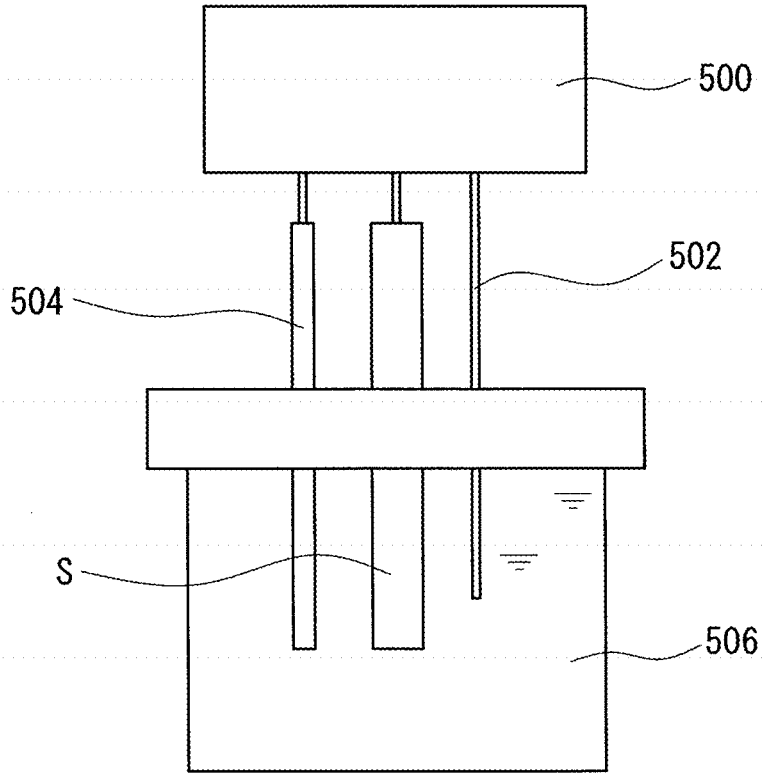
FIG. 4 is a diagram illustrating a method for measuring the thickness of an oxide film in Test Example 1.

A covered electrical wire was cut to a predetermined length, and a conductor was exposed by removing an insulating coating layer located on one end side of the covered electrical wire using an appropriate cutting tool such as a feather, outer peripheral elemental wires of a twisted wire constituting the conductor were removed to undo twists, and only the central elemental wire was exposed. At this time, the surface of the central elemental wire was prevented from being scratched. Here, the length of the exposed central elemental wire was set to about 2 cm (20 mm), and the remaining portion still had an insulating coating layer. An oxide film that might be present on the surface of the exposed central elemental wire was analyzed and quantified through electrochemical measurement. A commercially available potentiostat/galvanostat (VersaSTAT4-400 manufactured by Princeton Applied Research) was used as a measurement apparatus used in electrochemical measurement. A high concentration alkaline solution (a liquid mixture of 6 M KOH and 1 M LiOH, M indicates molarity) was used as an electrolyte. As shown in FIG. 4, a sample S in which the above-described central elemental wire was exposed was prepared as a working electrode, a Pt electrode was prepared as a counter electrode 502, and Ag/AgCl was prepared as a reference electrode 504, one end of the sample S at which the central elemental wire was exposed, one end of the counter electrode 502, and one end of the reference electrode 504 were immersed in an electrolyte 506, and the other ends thereof were attached to a measurement apparatus 500. With the sample S, the depth to which the central elemental wire was immersed in the electrolyte was about 2 cm. The potential was swept from the natural immersion potential to −1.7 V (vs. Ag/AgCl) at a sweep speed of 50 mV/s in this immersed state, and the position of a reduction peak and a quantity of reduced electricity were measured. Constituent components of a coating film and the thickness thereof were obtained from the measured position of the reduction peak and the measured amount of reduction charge. A constituent component of the coating film was mainly copper oxide such as CuO and $Cu_2O$, for example. Here, the thickness of the coating film was obtained from copper oxide.

With regard to the covered electrical wire of each of the prepared samples, the tensile strength (MPa) of a conductor, and breaking elongation (%) of a conductor were measured as follows. Results thereof are shown in Table 2.

A covered electrical wire was cut to a predetermined length, and a conductor was exposed by removing an insulating coating layer using an appropriate cutting tool such as a feather. The resulting conductor was used as a sample, and tensile testing was performed conforming to JIS Z 2241 (Metallic materials-Tensile testing-Method, 1998), using a general-purpose tension tester, under conditions that an evaluation distance GL is 250 mm and tensile speed is 50 mm/min. Tensile strength (MPa) was obtained using {breaking load (N)/the cross-sectional area ($mm^2$) of a conductor}. Breaking elongation (total elongation, %) was obtained using {breaking displacement (mm)/250 (mm)}×100.

With regard to a covered electrical wire of each of the prepared samples, the surface roughness Ra (μm) of a central elemental wire constituting a conductor and the surface roughness Ra (μm) of an outer peripheral elemental wire were measured as described below. Results thereof are shown in Table 2.

A covered electrical wire was cut to a predetermined length, and a conductor was exposed by removing an insulating coating layer using an appropriate cutting tool such as a feather, outer peripheral elemental wires of a twisted wire constituting the conductor were removed to undo twists, and the central elemental wire and the outer peripheral elemental wires were exposed. At this time, surfaces of the elemental wires were prevented from being scratched. Here, a surface roughness Ra was measured using a commercially available non-contact surface profiler (New View1100 manufactured by ZYGO). Specifically, with regard to an outer circumferential surface of the central elemental wire and the outer circumferential surface of the outer peripheral elemental wires, plane roughness (surface roughness along a circumferential direction thereof) equivalent to a circle was measured using a laser microscope provided in the non-contact surface profiler, and plane transformation was performed. Plane transformation can be performed automatically using the above-described commercially available surface profiler. A measurement area of plane roughness equivalent to a circle was set to 85 μm×64 μm, and the number of measurement samples was set such that n is equal to 3 (n=3) for a central elemental wire and an outer peripheral elemental wire. A surface roughness Ra was obtained by, with regard to plane-transformed roughness, calculating an arithmetic average deviation from the vertex (a center line) of the plane roughness equivalent to a circle. The average of surface roughnesses Ra of central elemental wires where n is equal to 3, and the average of surface roughnesses Ra of outer peripheral elemental wires where n is equal to 3 are shown in Table 2.

With regard to a covered electrical wire of each of the prepared samples, the amount of precipitates having a particle size of 1 μm or more that were present on elemental wires constituting a conductor was measured as described below. Results thereof are shown in Table 2.

A covered electrical wire was cut along the longitudinal section thereof, and elemental wires constituting a twisted wire were observed using a metallographical microscope. Here, the magnification was set to 1,000. Precipitates in a copper alloy were extracted from an observation image and the area thereof was obtained (see FIG. 6). The number of precipitates having a particle size of 1 μm or more was counted where the particle size is a diameter of an equivalent area circle of each precipitate. The number of precipitates having a particle size of 1 μm or more in a 1 $mm^2$-copper alloy piece (referred to as a "number ratio" hereinafter) was obtained by dividing the total number by a field of view (100 μm×150 μm). Here, three or more cross-sections were obtained from each sample, and a number ratio for each cross-section was obtained, and the value with the highest number ratio is shown in Table 2.

Characteristics of Insulating Coating Layer and the Like

With regard to the covered electrical wire of each of the prepared samples, a thickness uniformity ratio and a thickness ratio of an insulating coating layer were measured as follows. Results thereof are shown in Table 3.

A covered electrical wire was cut to a predetermined length, only the insulating coating layer was taken out using an appropriate cutting tool such as a stripper, and the insulating coating layer was sliced thinly to a thickness of about 0.1 mm. The resulting annular insulating coating layer was observed using an optical microscope, and, at an inner circumferential edge of the insulating coating layer that extends along the contour of the outer peripheral elemental wires, the minimum distance between the outer circumferential surface of the insulating coating layer and a crown portion of each outer peripheral elemental wire, excluding a portion that fills a twisting groove (a portion protruding in a mountain shape toward the center of the insulating coating layer), was measured (see thicknesses $t_1$ to $t_6$ in FIG. 2, six portions here). The maximum value and the minimum value were extracted from the obtained thicknesses $t_1$ to $t_6$, and (the maximum value/minimum value)×100 is regarded as a thickness uniformity ratio (%). The maximum thickness $t_{max}$ and the minimum thickness $t_{min}$ of the insulating coating layer were measured also at a portion that fills a twisting groove, and ($t_{min}/t_{max}$) was regarded as a thickness ratio. Here, the maximum thickness $t_{max}$ was the thickness of a portion that fills a twisting groove, and the minimum thickness $t_{min}$ was the minimum value of the thicknesses $t_1$ to $t_6$.

Evaluation of Covered Electrical Wire

Buckling Force

A terminal-equipped electrical wire was produced by attaching a crimp terminal to an end portion of a covered electrical wire of each of the prepared samples. Here, the crimp height was adjusted such that the ratio (the remaining area ratio) of the cross-sectional area of a compressed portion of a conductor to which the terminal portion is attached to the cross-sectional area of an uncompressed portion of the conductor to which the terminal portion is not attached was 0.79.

With regard to a terminal-equipped electrical wire of each of the prepared samples, a buckling force occurring when the terminal portion is housed in a terminal housing portion of a housing was measured presuming the following. Results thereof are shown in Table 3.

The terminal portion of the terminal-equipped electrical wire was held, and a leading end portion that is located opposite to the terminal portion of the covered electrical wire was pressed against a flat plate. In this test, a pressing operation was performed under the conditions that the length of the covered electrical wire is 10 mm (the length of a portion of the covered electrical wire that protrudes from a portion where the terminal portion is held to the above-described leading end portion), speed of the held terminal-equipped electrical wire is 200 mm/min, and the load applied when the above-described leading end portion of the covered electrical wire is pressed against the flat plate is changed. Also, the maximum load applied when a covered electrical wire buckled was measured, and the obtained maximum load was regarded as the buckling force (N).

Terminal Insertability

With regard to a terminal-equipped electrical wire of each of the prepared samples, a terminal-equipped electrical wire in which the above-described buckling force is 7 N or more was evaluated as G because the terminal-equipped electrical wire is unlikely to buckle and has good terminal insertability, a terminal-equipped electrical wire in which the buckling force is less than 7 N was evaluated as B because the terminal-equipped electrical wire is likely to buckle and has bad terminal insertability. Results of evaluation are shown in Table 3.

Contact Resistance

A terminal-equipped electrical wire was produced by attaching a crimp terminal to an end portion of a covered electrical wire of each of the prepared samples. Here, the crimp height was adjusted such that the above-described remaining area ratio was 0.85 or 0.90.

With regard to a terminal-equipped electrical wire of each of the prepared samples, contact resistance between a conductor and a terminal portion (mΩ/m) was measured based on JASO D616, Automotive Parts-Low Voltage Cables, no. 6.8. In this test, a crimp terminal was attached to each end portion of a covered electrical wire, and two points located 150 mm apart from each crimp terminal were used as resistance measurement points. A power source was attached to both crimp terminals, a voltage was applied to a terminal-equipped electrical wire including crimp terminals at both end portions thereof at an applied voltage of 15 mV and a flowing current of 15 mA, and resistance between the above-described two measurement points was measured. Contact resistance (mΩ/m) was obtained by subtracting the resistance of the covered electrical wire from the measured resistance value. Also, the case where the above-described contact resistance was 0.4 mΩ/m or less was evaluated as G due to low contact resistance, and the case where the contact resistance exceeded 0.4 mΩ/m was evaluated as B due to high contact resistance. Results of measurement and results of evaluation are shown in Table 3.

Weld Strength

With regard to a covered electrical wire of each of the prepared samples, a copper conductor constituted by pure copper was welded, and weld strength (N) was measured with reference to a method for measuring a peeling force of Patent Document 1 shown in FIG. 5. Results thereof are shown in Table 3.

Here, one covered electrical wire of each sample and two covered electrical wires including a pure copper conductor were prepared (both had a length of 150 mm), the insulating coating layer was removed from an end portion of each covered electrical wire to expose a copper alloy conductor and a copper conductor, and ultrasonic welding was performed with the copper conductor placed to hold the copper alloy conductor. A commercially available welding apparatus was used in welding. Also, two covered electrical wires including a copper conductor were pulled away from each other in a state in which the covered electrical wire of each sample including a copper alloy conductor was fixed. As shown in FIG. 5 disclosed in Patent Document 1, for example, a welding portion and a covered electrical wire of each sample were disposed in a horizontal direction, the covered electrical wire was fixed, the two covered electrical wires including a copper conductor were disposed in a vertical direction, and one of the two covered electrical wires was pulled upward and the other is pulled downward. A commercially available tension tester or the like was used in tensile testing. The maximum load (N) at which the welding portion broke was measured, and the obtained maximum load was regarded as weld strength. Note that strength of pure copper conductor is inferior to that of a copper alloy conductor. Thus, here, as shown in Table 3, the total cross-sectional area ($mm^2$) of two pure copper conductors was set to be larger than the cross-sectional area (0.13 $mm^2$ or 0.08 $mm^2$) of a conductor of each sample constituted by a copper alloy.

Adhesive Force of Insulating Coating Layer

With regard to a covered electrical wire of each of the prepared samples, the adhesive force (N) of an insulating coating layer to a conductor was measured based on JASO D618 as follows. Results thereof are shown in Table 3. In this test, a covered electrical wire having a length of 100 mm was prepared, the electrical insulating layer was removed at one end portion thereof to expose a conductor having a length of 50 mm. The exposed conductor was inserted into a through-hole of a holding plate. The inner diameter of this through-hole had a size such that the conductor can be inserted into the through-hole (the inner diameter thereof is slightly larger than the outer diameter of the conductor), but the insulating coating layer cannot pass through the through-hole (the inner diameter thereof is smaller than the outer diameter of the covered electrical wire). The holding plate was fixed, and one end of the conductor protruding from the holding plate was pulled. A pulling operation was performed while changing the load applied to pull the conductor, and the adhesive force (N) was obtained by obtaining the minimum load applied when the insulating coating layer separated from the conductor and the conductor was pulled out.

adhering amounts of many of the samples were 6 μg/g or less, and 5 μg/g or less. Also, the buckling forces of Samples No. 1-1 to No. 1-7 were 7 N or more. Also, it can be said that the smaller the oil adhering amount is, the less likely buckling is to occur (e.g., see comparison between Samples No. 1-6, No. 1-2, and No. 1-1 having the same conductor cross-sectional area, and see comparison between Samples No. 1-5 and No 1-3 having the same conductor cross-sectional area). On the other hand, it can be said that the

TABLE 2

| | Conductor | | | | Insulating coating | | | | | | Surface roughness Ra (μm) | | |
|---|---|---|---|---|---|---|---|---|---|---|---|---|---|
| Sample No. | Type of alloy | Cross-sectional area ($mm^2$) | Twist pitch (mm) | Compression ratio (%) | Constituent material | Thickness (mm) | Oil adhering amount (μg/g) | Thickness of oxide film (nm) | Tensile strength (MPa) | Breaking elongation (%) | Central elemental wire | Outer peripheral elemental wire | Number of precipitates (/$mm^2$) |
| 1-1 | precipitation + solid-solution | 0.13 | 16 | 13 | PVC | 0.23 | 4.6 | 4.1 | 470 | 10 | 0.0129 | 0.0111 | 18000 |
| 1-2 | precipitation + solid-solution | 0.13 | 12 | 18 | HF(PP) | 0.25 | 5.5 | 1.5 | 450 | 11 | 0.0143 | 0.0131 | 500 |
| 1-3 | solid-solution | 0.08 | 12 | 15 | HF(PP) | 0.25 | 2.5 | 0.6 | 840 | 2 | 0.0135 | 0.0115 | 0 |
| 1-4 | precipitation + solid-solution | 0.13 | 16 | 12 | PVC | 0.23 | 1.8 | 0.7 | 514 | 12 | 0.0264 | 0.0232 | 3000 |
| 1-5 | solid-solution | 0.08 | 12 | 12 | HF(PP) | 0.25 | 3.5 | 0.1 | 800 | 2 | 0.0230 | 0.0205 | 0 |
| 1-6 | precipitation + solid-solution | 0.13 | 16 | 18 | PVC | 0.23 | 8.7 | 3.2 | 472 | 14 | 0.0332 | 0.0294 | 1000 |
| 1-7 | precipitation + solid-solution | 0.13 | 16 | 13 | PVC | 0.23 | 1.4 | 9.3 | 451 | 17 | 0.0246 | 0.0223 | 2000 |
| 1-101 | solid-solution | 0.13 | 24 | 7 | PVC | 0.23 | 18 | 15 | 339 | 11 | 0.0263 | 0.0423 | 0 |
| 1-102 | precipitation | 0.13 | 24 | 7 | PVC | 0.23 | 15 | 40 | 408 | 16 | 0.0393 | 0.0630 | 33000 |
| 1-103 | precipitation | 0.13 | 24 | 35 | PVC | 0.18 | 11 | 50 | 380 | 17 | 0.4253 | 0.0071 | 30000 |
| 1-104 | precipitation | 0.13 | 28 | 35 | PVC | 0.20 | 12 | 30 | 350 | 17 | 0.3456 | 0.0056 | 20000 |
| 1-105 | precipitation | 0.13 | 28 | 7 | PVC | 0.22 | 30 | 25 | 405 | 12 | 0.0452 | 0.0832 | 21000 |

TABLE 3

| | Insulating coating layer | | | | | Contact resistance (mΩ/m) | | Pure copper | |
|---|---|---|---|---|---|---|---|---|---|
| Sample No. | Adhesive force (N) | Thickness uniformity ratio (%) | Thickness ratio tmin/tmax | Buckling force (N) | Terminal insertability | Remaining area ratio 0.85 | Remaining area ratio 0.90 | cross-sectional area ($mm^2$) | Weld strength (N) |
| 1-1 | 19 | 80.2 | 0.76 | 8.6 | G | G(0.25) | G(0.28) | 0.35 | 22 |
| 1-2 | 23 | 90.4 | 0.71 | 8.2 | G | G(0.22) | G(0.26) | 0.22 | 18 |
| 1-3 | 26 | 85.3 | 0.65 | 8.9 | G | G(0.20) | G(0.23) | 0.35 | 23 |
| 1-4 | 27 | 80.6 | 0.63 | 8.4 | G | G(0.21) | G(0.24) | 0.35 | 20 |
| 1-5 | 25 | 83.1 | 0.72 | 8.6 | G | G(0.18) | G(0.21) | 0.22 | 16 |
| 1-6 | 24 | 80.3 | 0.64 | 7.4 | G | G(0.24) | G(0.27) | 0.35 | 13 |
| 1-7 | 30 | 82.3 | 0.61 | 8.1 | G | G(0.35) | G(0.39) | 0.22 | 22 |
| 1-101 | 15 | 80.2 | 0.92 | 6.5 | B | G(0.39) | B(0.45) | 0.22 | 8 |
| 1-102 | 35 | 70.6 | 0.59 | 6.3 | B | B(0.50) | B(0.55) | 0.35 | 4 |
| 1-103 | 19 | 84.3 | 0.67 | 4.6 | B | B(0.55) | B(0.60) | 0.35 | 2 |
| 1-104 | 18 | 75.3 | 0.85 | 6.2 | B | B(0.55) | B(0.70) | 0.3 | 3 |
| 1-105 | 10 | 79.0 | 0.75 | 3.8 | B | B(0.50) | B(0.70) | 0.3 | 4 |

As shown in Tables 2 and 3, it was found that, when a conductor is a twisted wire in which elemental wires are concentrically twisted together, and the amount of oil adhering to the surface of the elemental wires constituting the twisted wire is small, buckling is unlikely to occur, and good workability for inserting the terminal portion into a housing was obtained. Specifically, the oil adhering amounts of Samples No. 1-1 to No. 1-7 were 10 μg/g or less, and the oil buckling forces of Samples No. 1-101 to No. 1-105 having an oil adhering amount of 11 μg/g or more were 6.5 N or less, and buckling is likely to occur, compared to Samples No. 1-1 to No. 1-7. From these findings, it can be said that the amount of oil adhering to the surface of an elemental wire affects the likelihood of buckling, and as a result of reducing the oil adhering amount, buckling is unlikely to occur.

As shown in Tables 2 and 3, it was found that, when a conductor is a twisted wire in which elemental wires are concentrically twisted together, and the amount of oil adhering to the surface of the elemental wires constituting the twisted wire is small, contact resistance between the conductor and a terminal portion is low. Specifically, the oil adhering amount of Samples No. 1-1 to No. 1-7 were 10 μg/g or less, and the oil adhering amount of many of the samples were 6 μg/g or less, and 5 μg/g or less. Also, the contact resistances of Samples No. 1-1 to No. 1-7 were 0.4 mΩ/m or less, and the contact resistances of many of the samples were 0.35 mΩ/m or less. Also, it can be said that the smaller the oil adhering amount is, the lower the contact resistance substantially is likely to be (e.g., see comparison between Samples No. 1-6, No. 1-2, and No. 1-4 having the same conductor cross-sectional area). Also, Samples No. 1-1 to No. 1-7 had low contact resistance at 0.4 mΩ/m or less, even if the remaining area of a compressed portion of a conductor where the terminal portion was compressed was large, that is, even if the remaining area ratio was large (here, in the case where the remaining area ratio was 0.90). On the other hand, Samples No. 1-101 to No. 1-105 having an oil adhering amount of 11 μg/g or more had higher contact resistance, compared to Samples No. 1-1 to No. 1-7, and many of these samples had a contact resistance of more than 0.4 mΩ/m. In particular, if the remaining area ratio was large at 0.90, the contact resistance of Samples No. 1-101 to No. 1-105 was high at 0.45 mΩ/m or more. From these findings, it was found that the amount of oil adhering to the surfaces of the elemental wires affects contact resistance between a conductor and a terminal portion, and as a result of reducing the oil adhering amount, the contact resistance can be reduced.

As shown in Tables 2 and 3, it was found that, when a conductor is a twisted wire in which elemental wires are concentrically twisted together, and the amount of oil adhering to the surface of the elemental wires constituting the twisted wire is small, good weld strength can be obtained. Specifically, the oil adhering amounts of Samples No. 1-1 to No. 1-7 were 10 μg/g or less, and the oil adhering amounts of many of the samples were 6 μg/g or less, and 5 μg/g or less. Also, the weld strengths of Samples No. 1-1 to No. 1-7 were 10 N or more, and 12 N or more. Also, it can be said that the smaller the oil adhering amount is, the higher the weld strength substantially is likely to be (e.g., see comparison between Samples No. 1-6, No. 1-2, and No. 1-1 having the same conductor cross-sectional area). On the other hand, Samples No. 1-101 to No. 1-105 having an oil adhering amount of 11 μg/g or more had low weld strength at 8 N or less. From these findings, it was found that the amount of oil adhering to the surfaces of the elemental wires affects weld strength if a conductor and a branch line or the like are welded to each other, and as a result of reducing the oil adhering amount, the weld strength can be increased.

In addition, the following can be understood from the results shown in Tables 2 and 3.

(1) Samples No. 1-1 to No. 1-7 had a thin coating film made of copper oxide that might be present on the surface of the elemental wires constituting the twisted wire. Specifically, the thicknesses of the coating films of Samples No. 1-1 to No. 1-7 were 10 nm or less, and the thicknesses of many of these coating films were 5 nm or less, and 3 nm or less, which are 20% or less of the maximum thickness (50 nm here) of the coating films of Samples No. 1-101 to No. 1-105, and the coating films were very thin. It is thought that a thin coating film made of copper oxide including an electrical insulating material contributes to a decrease in contact resistance and an increase in weld strength described above. Also, from this test, it was found that the thickness of a copper oxide coating film changes depending on the composition of the copper alloy and heat treatment conditions.

(2) Samples No. 1-1 to No. 1-7 had large tensile strength, specifically, had a tensile strength of 450 MPa or more, and some samples had a tensile strength of 500 MPa or more, or 800 MPa or more. It is thought that high strength contributes to an increase in buckling force and an increase in weld strength. Also, it is expected that, out of Samples No. 1-1 to No. 1-7, samples having a breaking elongation of 5% or more have high strength and high toughness, and have good impact resistance or the like.

(3) With Samples No. 1-1 to No. 1-7, although the conductor had a cross-sectional area of 0.15 $mm^2$ or less, or 0.13 $mm^2$ or less, the twist pitch was large at 12 mm or more. Also, the twist pitch of Samples No. 1-1 to No. 1-7 was 20 mm or less, and 16 mm or less. It is thought that, as a result of the twist pitch being in a specific range in this manner, the strength of a twisted wire constituting a conductor was increased, and elemental wires were likely to move as a whole, thus contributing to an increase in buckling force.

(4) With Samples No. 1-1 to No. 1-7, the conductor was a compressed twisted wire, and the compression ratio thereof was set to a specific range of 10% to 30% inclusive. It is expected that strength increases through work hardening in compression molding, and it is thought that setting the compression ratio to this specific range contributes to an increase in buckling force. Also, it is thought that, because each elemental wire had small surface roughness and the compression ratio was 10% to 30% inclusive, a difference between the surface roughness Ra of a central elemental wire and the surface roughness Ra of the outer peripheral elemental wires was likely to decrease, thus contributing to an increase in weld strength. Also, it is thought that each elemental wire and a terminal portion can easily come into surface contact with each other, thus contributing to a decrease in the above-described contact resistance.

(5) With Samples No. 1-1 to No. 1-7, the insulating coating layer had a high thickness uniformity ratio, specifically, had a thickness uniformity ratio of 80% or more, and many insulating coating layers had a thickness uniformity ratio of 82% or more. It can be said that an insulating coating layer is uniformly formed on the conductor, and as a result, rigidity of the entire covered electrical wire was increased, and it is thought that a high thickness uniformity ratio contributes to an increase in buckling force. It is thought that, as described above, in this test, the conductor had a small cross-sectional area, but the insulating coating layer had an average thickness of 0.21 mm or more, and thus, the above-described rigidity was increased, thus contributing to an increase in buckling force. Also, it is thought that, in this test, the thickness ratio of the insulating coating layer was set to a specific range of 0.6 to 0.9 inclusive, and a constituent resin of the insulating coating layer entered twisting grooves of the twisted wire, and thus adhesive force between the conductor and the insulating coating layer was increased, thus contributing to an increase in buckling force. Also, from this test, it is understood that, even if the insulating coating layer is relatively thick, as a result of forming the insulating coating layer in a state in which the conductor is heated, the twisting grooves are also appropriately filled with a constituent resin at a uniform thickness as described above.

(6) With Samples No. 1-1 to No. 1-7, the surfaces of the central elemental wires and the outer peripheral elemental wires were smooth, specifically, the surface roughness Ra thereof was 0.05 μm or less. In this test, with Samples No. 1-1 to No. 1-7, a difference between the surface roughness Ra of a central elemental wire and the surface roughness Ra of outer peripheral elemental wires was small, and the difference was 0.005 μm or less. It is thought that this enables a copper alloy conductor and a pure copper conductor to easily come into contact with each other in welding and to be accurately welded to each other, thus contributing to an increase in weld strength. With Samples No. 1-101, No. 1-102, and No. 1-105, the surface roughness Ra of outer peripheral elemental wires was larger than the surface roughness Ra of a central elemental wire. It is thought that one reason for this is that Samples No. 1-101, No. 1-102, and No. 1-105 had an excessively small compression ratio described above, the outer peripheral elemental wire hardly underwent plastic deformation, and a rough surface state before compression was likely to be maintained. With Samples No. 1-103 and No. 1-104, the surface roughness Ra of outer peripheral elemental wires was very small, and the surface roughness Ra of a central elemental wire was very large. It is thought that one reason for this is that, since Samples No. 1-103 and No. 1-104 had an excessively large compression ratio described above, a large plastic deformation occurred on the outer peripheral elemental wire, forming a portion where the surface roughness Ra was smooth, while the central elemental wire pressed by the outer peripheral elemental wires was likely to have a large surface roughness Ra. It is thought that, with Samples No. 1-101 to No. 1-105 having a large surface roughness Ra or a large difference between surface roughnesses described above, there is a possibility that non-uniform contact between welding objects will occur, resulting in variation in a welding state. In addition, from this test, it is thought that, as a result of the elemental wires constituting the twisted wire having a small surface roughness at 0.05 μm or less, a lubricant is unlikely to remain, and the oil adhering amount is likely to decrease.

Figure 6:
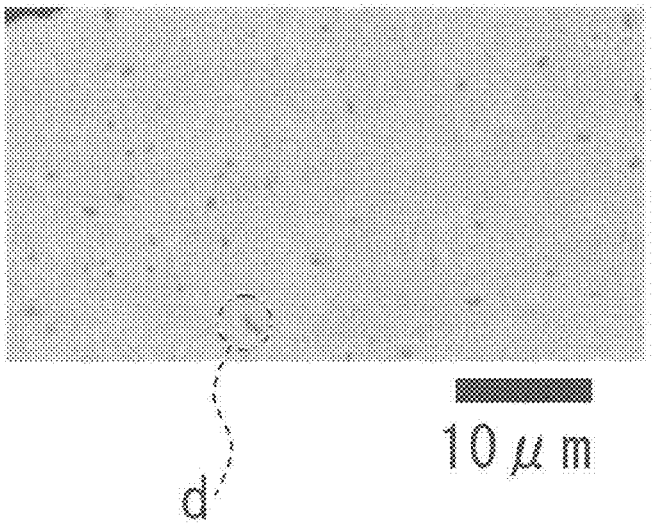
FIG. 6 is a microphotograph showing an enlarged portion of a conductor of Sample No. 1-1, of a cross-section of the conductor in Test Example 1.

(7) In Samples No. 1-1 to No. 1-7, Samples No. 1-1, No. 1-2, No. 1-4, No. 1-6, and No. 1-7 constituted by a precipitation copper alloy had a small number of coarse precipitates having a size of 1 μm or more, and specifically, the number of precipitates was 20,000/mm$^2$ or less. FIG. 6 shows a microphotograph of an elemental wire (a copper alloy wire) forming a conductor provided in the covered electrical wire of Sample No. 1-1, and particles d located in a dashed circle indicate precipitates. As shown in FIG. 6, it is understood that minute precipitates were dispersed in the elemental wires of Sample No. 1-1, and the number of coarse precipitates having a particle size of 1 μm or more was small. Reducing the number of coarse precipitates described above makes it possible to reduce a difference between structures of a copper alloy conductor and a pure copper conductor that are to be welded to each other. It is thought that this enables a copper alloy conductor and a pure copper conductor to easily come into contact with each other in welding and to be accurately welded to each other, thus contributing to an increase in weld strength.

The present invention is not limited to these examples, and is defined by the claims, and all changes that come within the meaning and range of equivalency of the claims are intended to be embraced therein.

The composition of a copper alloy of Test Example 1, the cross-sectional area of a copper alloy wire, the number of elemental wires, and heat treatment conditions can be changed as appropriate, for example.

LIST OF REFERENCE NUMERALS

1 Covered electrical wire
10 Terminal-equipped electrical wire
2 Conductor
20 Elemental wire
21 Central elemental wire
22 Outer peripheral elemental wire
25 Twisting groove
200 Envelope circle
220 Crown portion
3 Insulating coating layer
4 Terminal portion
40 Wire barrel portion
42 Fitting portion
44 Insulation barrel portion
S Sample
500 Measurement apparatus
502 Counter electrode
504 Reference electrode
506 Electrolyte
510 Outer circumferential edge
512 Twisting groove
d Particle

The invention claimed is:

1. A covered electrical wire comprising:
a conductor; and
an insulating coating layer covering an outer periphery of the conductor,
wherein the conductor is a twisted wire obtained by concentrically twisting together a plurality of elemental wires constituted by a copper alloy,
the copper alloy contains one or more elements selected from Fe, Ti, Mg, Sn, Ag, Ni, In, Zn, Cr, Al, and P in a total amount of 0.01 mass % to 5.5 mass % inclusive, and the remaining portion includes Cu and inevitable impurities, and
an amount of oil adhering to a surface of a central elemental wire disposed at a central portion of the twisted wire is 10 μg/g or less with respect to the mass of the central elemental wire.

2. The covered electrical wire according to claim 1, comprising
a coating film made of copper oxide on surfaces of the elemental wires,
wherein the coating film has a thickness of 10 nm or less.

3. The covered electrical wire according to claim 1,
wherein the conductor has a tensile strength of 450 MPa or more, and has a breaking elongation of 5% or more.

4. The covered electrical wire according to claim 1,
wherein the conductor has a cross-sectional area of 0.22 mm$^2$ or less, and
the twisted wire has a twist pitch of 12 mm or more.

5. The covered electrical wire according to claim 1,
wherein, when the minimum distance between an outer circumferential surface of the insulating coating layer and a crown portion, excluding a twisting groove, of an outer circumferential surface of each outer peripheral elemental wire disposed on the outermost side of the twisted wire is a thickness of the insulating coating layer, a ratio of the minimum value of the thickness to the maximum value of the thickness is 80% or more.

6. A terminal-equipped electrical wire comprising:

the covered electrical wire according to claim 1; and a terminal portion attached to an end portion of the covered electrical wire.

7. The terminal-equipped electrical wire according to claim 6, wherein, when a ratio of a cross-sectional area of a compressed portion of the conductor to which the terminal portion is attached to a cross-sectional area of an uncompressed portion of the conductor to which the terminal portion is not attached is a remaining area ratio, the remaining area ratio exceeds 0.76.

8. The covered electrical wire according to claim 2, wherein the conductor has a tensile strength of 450 MPa or more, and has a breaking elongation of 5% or more.

9. The covered electrical wire according to claim 2, wherein the conductor has a cross-sectional area of 0.22 $mm^2$ or less, and the twisted wire has a twist pitch of 12 mm or more.

10. The covered electrical wire according to claim 3, wherein the conductor has a cross-sectional area of 0.22 $mm^2$ or less, and the twisted wire has a twist pitch of 12 mm or more.

11. The covered electrical wire according to claim 8, wherein the conductor has a cross-sectional area of 0.22 $mm^2$ or less, and the twisted wire has a twist pitch of 12 mm or more.

12. The covered electrical wire according to claim 2, wherein, when the minimum distance between an outer circumferential surface of the insulating coating layer and a crown portion, excluding a twisting groove, of an outer circumferential surface of each outer peripheral elemental wire disposed on the outermost side of the twisted wire is a thickness of the insulating coating layer, a ratio of the minimum value of the thickness to the maximum value of the thickness is 80% or more.

13. The covered electrical wire according to claim 3, wherein, when the minimum distance between an outer circumferential surface of the insulating coating layer and a crown portion, excluding a twisting groove, of an outer circumferential surface of each outer peripheral elemental wire disposed on the outermost side of the twisted wire is a thickness of the insulating coating layer, a ratio of the minimum value of the thickness to the maximum value of the thickness is 80% or more.

14. The covered electrical wire according to claim 4, wherein, when the minimum distance between an outer circumferential surface of the insulating coating layer and a crown portion, excluding a twisting groove, of an outer circumferential surface of each outer peripheral elemental wire disposed on the outermost side of the twisted wire is a thickness of the insulating coating layer, a ratio of the minimum value of the thickness to the maximum value of the thickness is 80% or more.

15. The covered electrical wire according to claim 8, wherein, when the minimum distance between an outer circumferential surface of the insulating coating layer and a crown portion, excluding a twisting groove, of an outer circumferential surface of each outer peripheral elemental wire disposed on the outermost side of the twisted wire is a thickness of the insulating coating layer, a ratio of the minimum value of the thickness to the maximum value of the thickness is 80% or more.

16. The covered electrical wire according to claim 9, wherein, when the minimum distance between an outer circumferential surface of the insulating coating layer and a crown portion, excluding a twisting groove, of an outer circumferential surface of each outer peripheral elemental wire disposed on the outermost side of the twisted wire is a thickness of the insulating coating layer, a ratio of the minimum value of the thickness to the maximum value of the thickness is 80% or more.

17. The covered electrical wire according to claim 10, wherein, when the minimum distance between an outer circumferential surface of the insulating coating layer and a crown portion, excluding a twisting groove, of an outer circumferential surface of each outer peripheral elemental wire disposed on the outermost side of the twisted wire is a thickness of the insulating coating layer, a ratio of the minimum value of the thickness to the maximum value of the thickness is 80% or more.

18. The covered electrical wire according to claim 11, wherein, when the minimum distance between an outer circumferential surface of the insulating coating layer and a crown portion, excluding a twisting groove, of an outer circumferential surface of each outer peripheral elemental wire disposed on the outermost side of the twisted wire is a thickness of the insulating coating layer, a ratio of the minimum value of the thickness to the maximum value of the thickness is 80% or more.

* * * * *